US010790587B2

(12) United States Patent
Koga et al.

(10) Patent No.: US 10,790,587 B2
(45) Date of Patent: Sep. 29, 2020

(54) MULTIBAND ANTENNA AND RADIO COMMUNICATION APPARATUS

(71) Applicant: FUJITSU LIMITED, Kawasaki-shi, Kanagawa (JP)

(72) Inventors: Yohei Koga, Kawasaki (JP); Manabu Kai, Yokohama (JP); Masatomo Mori, Kawasaki (JP); Tabito Tonooka, Kawasaki (JP); Takashi Yamagajo, Yokosuka (JP)

(73) Assignee: FUJITSU LIMITED, Kawasaki (JP)

( * ) Notice: Subject to any disclaimer, the term of this patent is extended or adjusted under 35 U.S.C. 154(b) by 10 days.

(21) Appl. No.: 16/357,103

(22) Filed: Mar. 18, 2019

(65) Prior Publication Data

US 2019/0214725 A1 Jul. 11, 2019

Related U.S. Application Data

(63) Continuation of application No. PCT/JP2018/004179, filed on Feb. 7, 2018.

(30) Foreign Application Priority Data

Mar. 9, 2017 (JP) ..... 2017-045029

(51) Int. Cl.
*H01Q 1/24* (2006.01)
*H01Q 5/307* (2015.01)
(Continued)

(52) U.S. Cl.
CPC ..... *H01Q 5/307* (2015.01); *H01Q 1/24* (2013.01); *H01Q 1/243* (2013.01); *H01Q 5/371* (2015.01); *H01Q 21/30* (2013.01)

(58) Field of Classification Search
CPC ..... H01Q 5/307; H01Q 5/371; H01Q 1/243; H01Q 1/24; H01Q 21/30
See application file for complete search history.

(56) References Cited

U.S. PATENT DOCUMENTS 9,203,141 B1 12/2015 Su et al.
2005/0225484 A1 10/2005 Kuramoto
(Continued)

FOREIGN PATENT DOCUMENTS

JP 2001-251128 A 9/2001
JP 2005-303721 A 10/2005
(Continued)

OTHER PUBLICATIONS

International Search Report and Written Opinion, issued by International Searching Authority in corresponsing International Application No. PCT/JP2018/004179, dated May 1, 2018.

*Primary Examiner* — Dieu Hien T Duong
(74) *Attorney, Agent, or Firm* — Arent Fox LLP

(57) ABSTRACT

A multiband antenna includes a ground conductor, a first conductor disposed at a predetermined distance from the ground conductor, formed linearly, and configured to have a length to resonate at first and second frequencies, the first conductor including a power feeding point, a second conductor coupled to the first conductor at both ends of the second conductor, disposed closer to a side of the ground conductor than the first conductor, formed linearly, and configured to form a slit between the first and second conductors and resonate together with the first conductor at a third frequency, and a third conductor provided at one or more ends of the first conductor and configured to extend from a first end of the one or more ends to the side of the ground conductor to be electromagnetically coupled to the ground conductor at the third frequency, wherein the conductors has conductivity.

16 Claims, 21 Drawing Sheets

(51) Int. Cl.
*H01Q 21/30* (2006.01)
*H01Q 5/371* (2015.01)

(56) References Cited

U.S. PATENT DOCUMENTS

| | | | | |
|---|---|---|---|---|
| 2008/0158064 | A1 | 7/2008 | Ponce De Leon et al. | |
| 2011/0223873 | A1* | 9/2011 | Qiu | H01Q 5/357 455/90.2 |
| 2012/0182190 | A1 | 7/2012 | Yui et al. | |
| 2013/0300615 | A1 | 11/2013 | Wong et al. | |
| 2014/0085160 | A1 | 3/2014 | Valkonen et al. | |
| 2014/0300527 | A1 | 10/2014 | Lo et al. | |
| 2014/0340277 | A1 | 11/2014 | Wong et al. | |
| 2015/0145738 | A1 | 5/2015 | Wong et al. | |
| 2016/0329625 | A1* | 11/2016 | Lin | H01Q 5/328 |

FOREIGN PATENT DOCUMENTS

| | | | |
|---|---|---|---|
| JP | 2006-014265 | A | 1/2006 |
| JP | 2008-042600 | A | 2/2008 |
| JP | 2012-060380 | A | 3/2012 |
| WO | WO-2011/045930 | A1 | 4/2011 |

* cited by examiner

MULTIBAND ANTENNA AND RADIO COMMUNICATION APPARATUS

CROSS-REFERENCE TO RELATED APPLICATION

This application is a continuation application of International Application PCT/JP2018/004179 filed on Feb. 7, 2018 and designated the U.S., the entire contents of which are incorporated herein by reference. The International Application PCT/JP2018/004179 is based upon and claims the benefit of priority of the prior Japanese Patent Application No. 2017-045029, filed on Mar. 9, 2017, the entire contents of which are incorporated herein by reference.

FIELD

The embodiments discussed herein are related to a multiband antenna usable in, for example, multiple frequency bands, and a radio communication apparatus having the multiband antenna.

BACKGROUND

In a radio communication terminal such as a mobile phone, in order to accomplish the high speed of the radio communication or cope with multiple radio communication services, it has been demanded to broaden the bands usable by an antenna mounted in the radio communication terminal. Thus, there has been suggested a broadband antenna in which a single power feeding point is provided in a narrow-width-shaped conductor formed with multiple slits having no opening end, an inner conductor of a coaxial cable is connected to the power feeding point, and an outer conductor of the coaxial cable is connected to an earth point on a ground plate (see, e.g., Japanese Laid-open Patent Publication No. 2006-014265).

SUMMARY

According to an aspect of the invention, a multiband antenna includes a ground conductor coupled to a ground, a first conductor disposed at a predetermined distance from the ground conductor, formed linearly, and configured to have a length to resonate at a first frequency and a second frequency different from the first frequency, the first conductor including a power feeding point at which an electric power is supplied, a second conductor coupled to the first conductor at both ends of the second conductor, disposed closer to a side of the ground conductor than the first conductor, formed linearly, and configured to form a slit between the first conductor and the second conductor and resonate together with the first conductor at a third frequency different from the first frequency and the second frequency, and a third conductor provided at one or more ends of the first conductor and configured to extend from a first end of the one or more ends to the side of the ground conductor to be electromagnetically coupled to the ground conductor at the third frequency, wherein each of the ground conductor, the first conductor, the second conductor, and the third conductor has a conductivity.

The object and advantages of the disclosure will be realized and attained by means of the elements and combinations particularly pointed out in the claims.

It is to be understood that both the foregoing general description and the following detailed description are exemplary and explanatory and are not restrictive of the disclosure, as claimed.

DESCRIPTION OF EMBODIMENTS

In order to improve the convenience of the radio communication terminal, the radio communication terminal may be made thin, or the display mounted on the radio communication terminal may be made large. Thus, in order to enhance the rigidity of the radio communication terminal, the most part of the frame of the radio communication terminal may be formed of metal. In this case, the broadband antenna described above is disposed to overlap with the frame, and as a result, the gain of the broadband antenna decreases.

Accordingly, there has been a demand for a multiband antenna which is usable in the radio communication terminal using the frame mostly formed of metal and usable in multiple frequency bands.

Hereinafter, the multiband antenna which is usable in multiple frequency bands will be described with reference to the accompanying drawings. The multiband antenna includes a linear first conductor that is disposed at a predetermined distance from a ground conductor, is able to resonate at a first frequency and a second frequency, and is fed with power. Further, the multiband antenna includes a linear second conductor that is disposed closer to the side of the ground conductor than the first conductor, is electrically connected to the first conductor at both the ends thereof so as to form a slit together with the first conductor, and is able to resonate together with the first conductor at a third frequency. Further, the multiband antenna includes a third conductor that extends from at least one end of the first conductor toward the ground conductor and is electromagnetically coupled to the ground conductor at the third frequency. This multiband antenna is usable at the first frequency, the second frequency, and the third frequency.

Figure 1A:
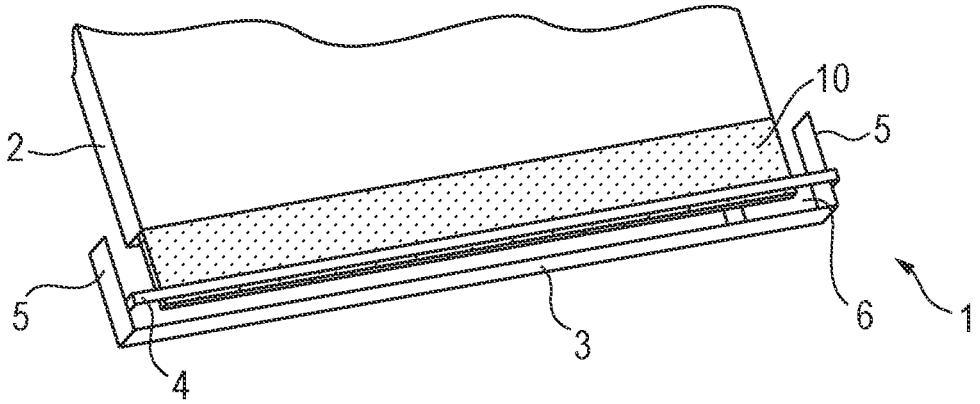
FIG. 1A is a perspective view of a multiband antenna according to a first embodiment.
Figure 1B:
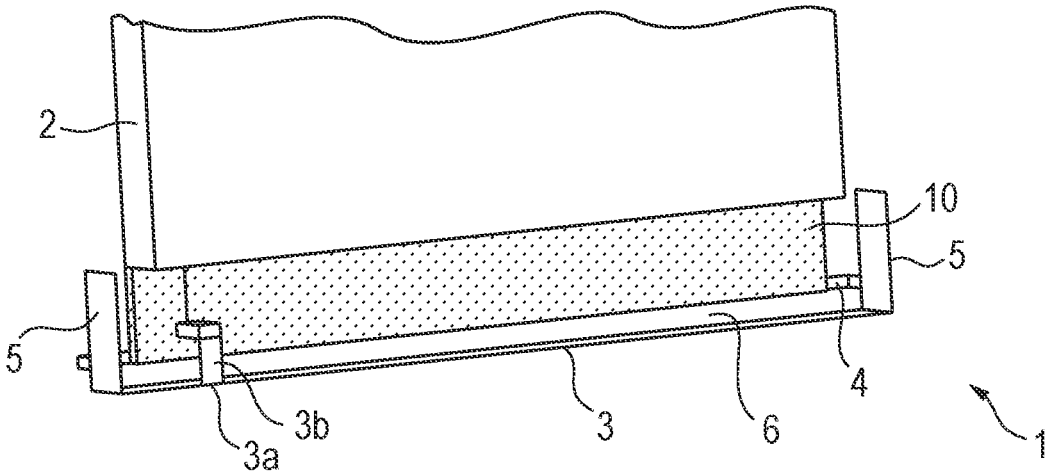
FIG. 1B is a perspective view of the multiband antenna when viewed from the opposite side.

FIG. 1A is a perspective view of a multiband antenna according to a first embodiment. In addition, FIG. 1B is a perspective view of the multiband antenna when viewed from the opposite side to FIG. 1A. A multiband antenna 1 according to the first embodiment includes a ground conductor 2, a first conductor 3, a second conductor 4, and a third conductor 5. The multiband antenna 1 is mounted in, for example, a radio communication terminal such as a mobile phone, and radiates or receives radio waves of multiple frequency bands which are used in the radio communication terminal. In the following description, for the convenience, the normal direction of the face of the ground conductor 2 which is formed in a flat-plate shape will be defined as the upper direction of the multiband antenna.

The ground conductor 2 is formed by a conductor such as copper or gold in a flat-plate shape, and is grounded. For example, the ground conductor 2 is provided to cover one surface of a substrate 10 that is provided in the radio communication terminal in which the multiband antenna 1 is to be mounted, and the lateral surface of the substrate 10 on the side where the third conductor 5 is to be provided.

The first conductor 3 is formed by a conductor such as copper or gold in a linear plate shape. The first conductor 3 is disposed at a predetermined distance from the ground conductor 2, such that the longitudinal direction of the first conductor 3 is substantially parallel with one end of the ground conductor 2 on the side of the first conductor 3, and the short direction, that is, the width direction of the first conductor 3 is toward the direction crossing the surface of the substrate on which the ground conductor 2 is provided. In addition, the first conductor 3 has an electrical length which is approximately $(1/4+N/2)\lambda$ (where N is an integer of 1 or more) with respect to a wavelength $\lambda$ corresponding to one frequency of radio waves used by the multiband antenna 1. Accordingly, since the first conductor 3 resonates with the radio waves having the corresponding frequency, the multiband antenna 1 is able to receive or radiate the radio waves having the corresponding frequency. In addition, since the first conductor 3 has an electrical length which is $\lambda_2/4$ with respect to radio waves having a frequency with a wavelength $\lambda_2=\{(1+2N)\lambda\}$ as well, the first conductor 3 resonates at the corresponding frequency as well. Thus, the multiband antenna 1 is also able to receive or radiate the radio waves having the frequency corresponding to the wavelength $\lambda_2$. In the following description, the frequency corresponding to the wavelength $\lambda_2$ will be referred to as a first frequency, and the frequency corresponding to the wavelength $\lambda$ will be referred to as a second frequency.

Further, a power feeding point 3*a* is provided in the middle of the first conductor 3, and the first conductor 3 is fed with power via a projection 3*b* that is formed to extend from the power feeding point 3*a* toward the side of the ground conductor 2. In addition, the protrusion 3*b* is provided to cross a slit 6 that is formed between the first conductor 3 and the second conductor 4. Accordingly, the first conductor 3 is fed with power at the power feeding point 3*a* so as to cross the slit 6 (power is fed to cross the slit 6 in this example, but power may be fed without crossing the slit 6), and a resonance occurs with the radio waves having the third frequency in a loop formed by the first conductor 3 and the second conductor 4 to surround the slit 6.

In addition, the first conductor 3 may be fed with power in the manner that instead of the projection 3*b*, a power feeding line formed by a conductor is electrically connected to the power feeding point 3*a*. In this case as well, the power feeding line is provided to cross the slit 6.

The second conductor 4 is formed by, for example, a conductor such as copper or gold in a linear shape. The longitudinal direction of the second conductor 4 is substantially parallel with the first conductor 3, and both ends of the second conductor 4 are electrically connected to the first conductor 3 via the third conductor 5. In addition, the second conductor 4 is disposed closer to the side of the ground conductor 2 than the first conductor 3, so as to form the slit 6 between the first conductor 3 and the second conductor 4.

In addition, the second conductor 4 may be formed such that at least one of both ends thereof is directly connected to the first conductor 3.

The third conductor 5 is formed by, for example, a conductor such as copper or gold in a linear plate shape. The third conductor 5 is formed such that one end of the third conductor 5 is electrically connected to one end of the first conductor 3, and the other end of the third conductor 5 extends toward the side of the ground conductor 2. In the present embodiment, two third conductors 5 are provided to extend from both ends of the first conductor 3 toward the side of the ground conductor 2, respectively. However, the third conductor 5 may be formed only on the side of one end of the first conductor 3.

The third conductor 5 is preferably disposed such that the other end of the third conductor 5 and the ground conductor 2 are close to each other to the extent that the third conductor 5 is electrically coupled to the ground conductor 2, and currents having the third frequency may flow to the ground conductor 2 via the third conductor 5. Accordingly, the loop formed by the first conductor 3 and the second conductor 4 to surround the slit 6 may resonate at the third frequency corresponding to the electrical length which is approximately ½ of the longitudinal length of the slit 6. As a result, the multiband antenna 1 is able to receive or radiate the radio waves having the third frequency.

In addition, the first conductor 3, the second conductor 4, and the third conductor 5 may be integrally formed by a single conductor. Alternatively, the first conductor 3, the second conductor 4, and the third conductor 5 may be formed by different conductors from each other. In addition, each of the first conductor 3 and the third conductor 5 may be a portion of the frame of the radio communication terminal in which the multiband antenna 1 is to be mounted.

Hereinafter, the radiation characteristic of the multiband antenna 1 which is obtained by an electromagnetic field simulation will be described. In the following description, in the electromagnetic field simulation for the multiband antenna according to each embodiment and modification, it is assumed that the multiband antenna is used at an 800 MHz band (an example of the first frequency), a 1.5 GHz band (an example of the third frequency), and a 2 GHz band (an example of the second frequency) which are used in the long term evolution (LTE).

Figure 2:
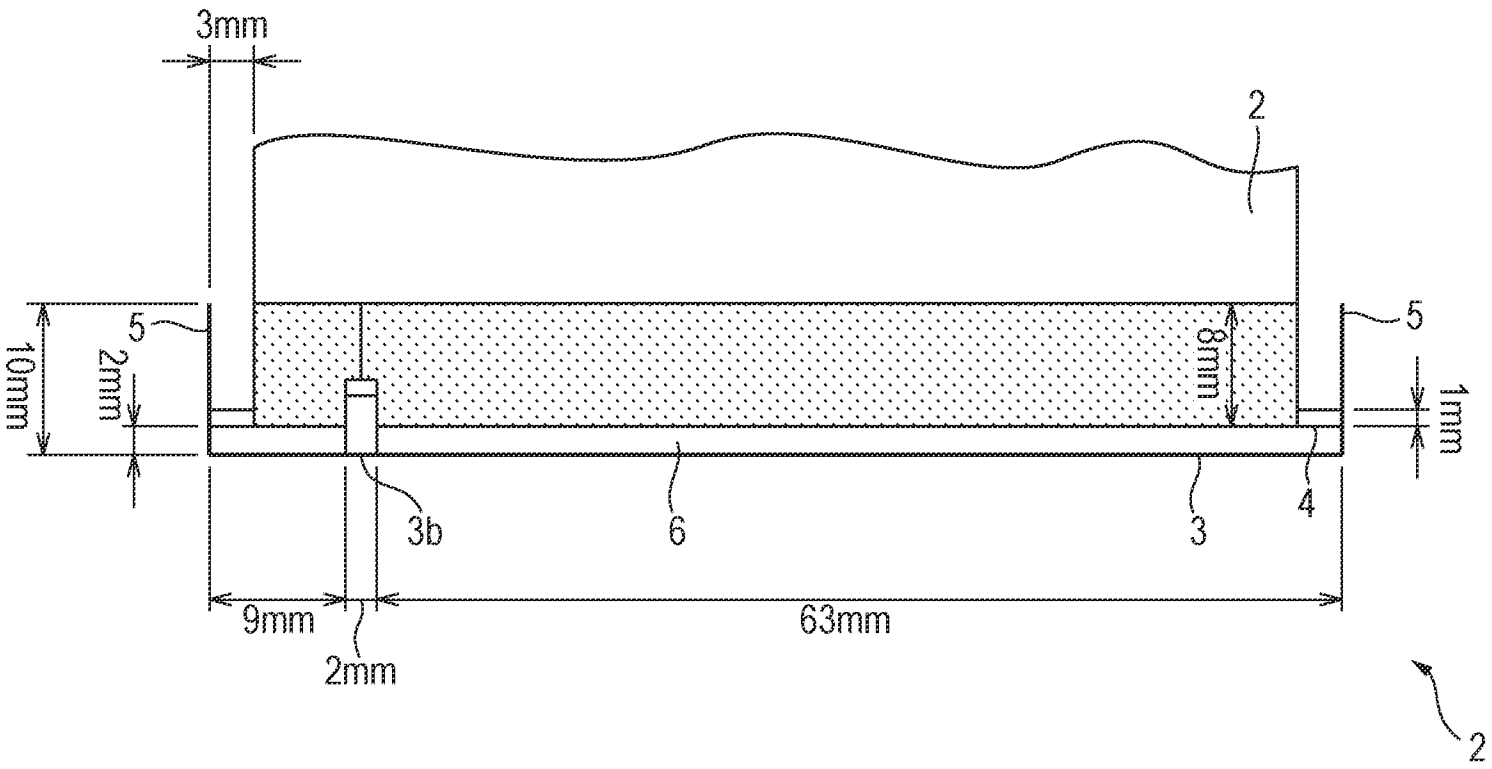
FIG. 2 is a plan view of the multiband antenna for illustrating dimensions of respective parts of the multiband antenna which are used for an electromagnetic field simulation of a radiation characteristic of the multiband antenna according to the first embodiment.

FIG. 2 is a plan view of the multiband antenna 1 according to the first embodiment for illustrating dimensions of the respective parts of the multiband antenna 1 which are used in the electromagnetic field simulation of the radiation characteristic of the multiband antenna 1. In this simulation, the conductivity of each of the ground conductor 2, the first conductor 3, the second conductor 4, and the third conductor 5 is set to $1.0\times10^5$ (S/m). The longitudinal length of the first conductor 3 is set to 74 mm, and it is assumed that the protrusion 3*b* having a width of 2 mm is formed 9 mm away from one end of the first conductor 3. In addition, the width of each of the first conductor 3 and the third conductor 5 is set to 4.5 mm, and the width of the second conductor 4 is set to 1 mm. The distance between the first conductor 3 and the ground conductor 2 is set to 10 mm. In addition, the distance between the first conductor 3 and the second conductor 4, that is, the width of the slit 6 is set to 2 mm. In addition, the length of the third conductor 5 is set to 10 mm, and the distance between the third conductor 5 and the ground conductor 2 is set to 3 mm. In addition, it is assumed that the first conductor 3 is fed with power through a matching circuit. In addition, in the electromagnetic field simulation for each embodiment or modification to be described hereinafter as well, it is assumed that the first conductor 3 is fed with power through the matching circuit.

Figure 3:
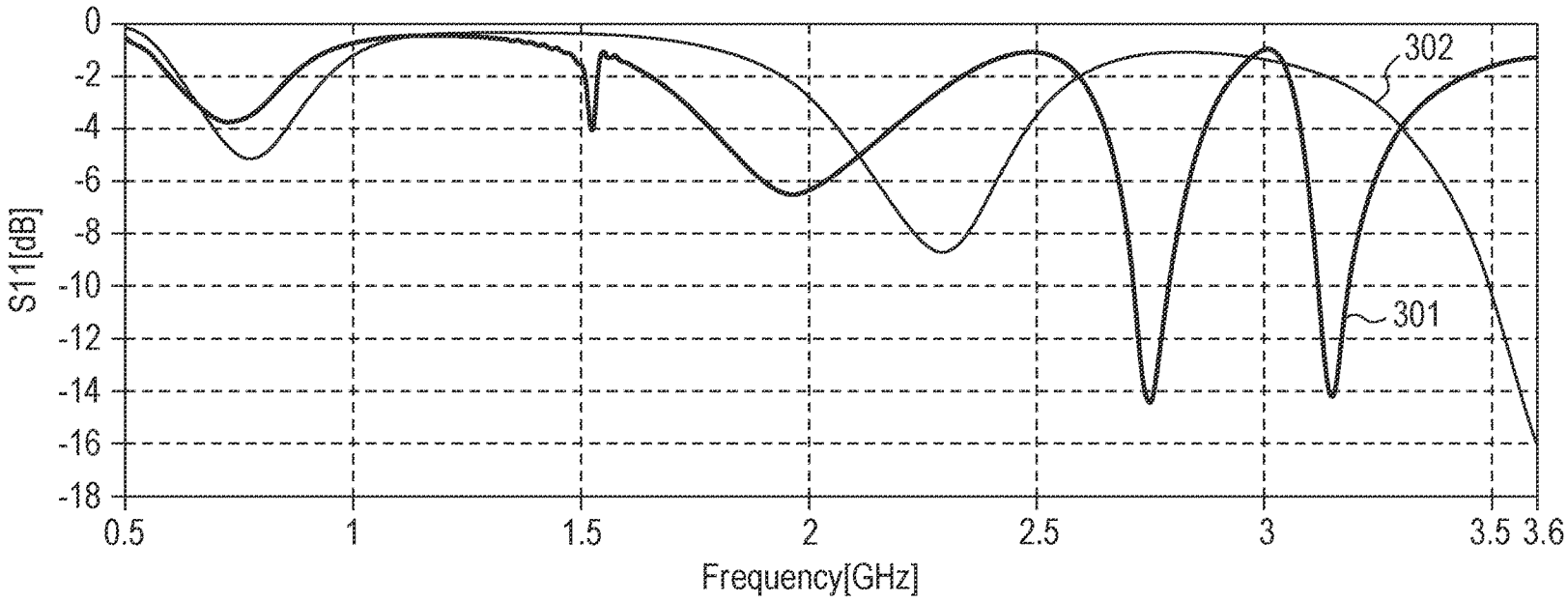
FIG. 3 is a graph illustrating a frequency characteristic of an $S_{11}$ parameter of the multiband antenna according to the first embodiment.

FIG. 3 is a graph illustrating a frequency characteristic of an $S_{11}$ parameter of the multiband antenna 1. In FIG. 3, the horizontal axis represents the frequency [GHz], and the vertical axis represents the $S_{11}$ parameter [dB]. A graph 301 represents the frequency characteristic of the $S_{11}$ parameter of the multiband antenna 1 which is obtained by the electromagnetic field simulation. In addition, a graph 302, as a comparative example, represents a frequency characteristic of an $S_{11}$ parameter of a monopole antenna obtained by removing the second conductor 4 and the third conductor 5 from the multiband antenna 1, which is obtained by the electromagnetic field simulation.

As represented by the graph 302, it may be understood that since the $S_{11}$ parameter has a minimum value of −3 dB or less in the 800 MHz band and the 2 GHz band, the monopole antenna of the comparative example resonates in the 800 MHz band and the 2 GHz band. Meanwhile, as represented by the graph 301, it may be understood that since the $S_{11}$ parameter has the minimum value of −3 dB or less in the 1.5 GHz band as well, in addition to the 800 MHz band and the 2 GHz band, the multiband antenna 1 according to the present embodiment resonates in the 1.5 GHz band as well, in addition to the 800 MHz band and the 2 GHz band. From this result, it may be understood that the multiband antenna 1 according to the present embodiment is usable in the 1.5 GHz band as well, in addition to the 800 MHz band and the 2 GHz band.

As described above, the multiband antenna includes the second conductor that forms the slit together with the linear first conductor which resonates in the two frequency bands, at the position closer to the side of the ground conductor than the first conductor. In addition, in the multiband antenna, the first conductor is fed with power, and the third conductor is provided to extend from at least one end of the first conductor toward the ground conductor and to be able to be electromagnetically coupled to the ground conductor. Accordingly, the multiband antenna is usable not only at the first and second frequencies at which the first conductor is able to resonate, but also at the third frequency at which the loop formed by the first conductor and the second conductor to surround the slit resonates. In addition, since the multiband antenna is able to receive or radiate radio waves as long as the first conductor and the second conductor are not surrounded by a metallic member, the multiband antenna may be mounted in the radio communication terminal in which the most part of the frame is formed of metal. Alternatively, the multiband antenna may be mounted in the radio communication terminal, in the manner that a portion of the frame of the radio communication terminal is formed by the first conductor and the third conductor, and the frame itself is used as an antenna.

Subsequently, a multiband antenna according to a second embodiment will be described. In the multiband antenna according to the second embodiment, the third conductor is formed to surround the outer periphery of the ground conductor.

Figure 4:
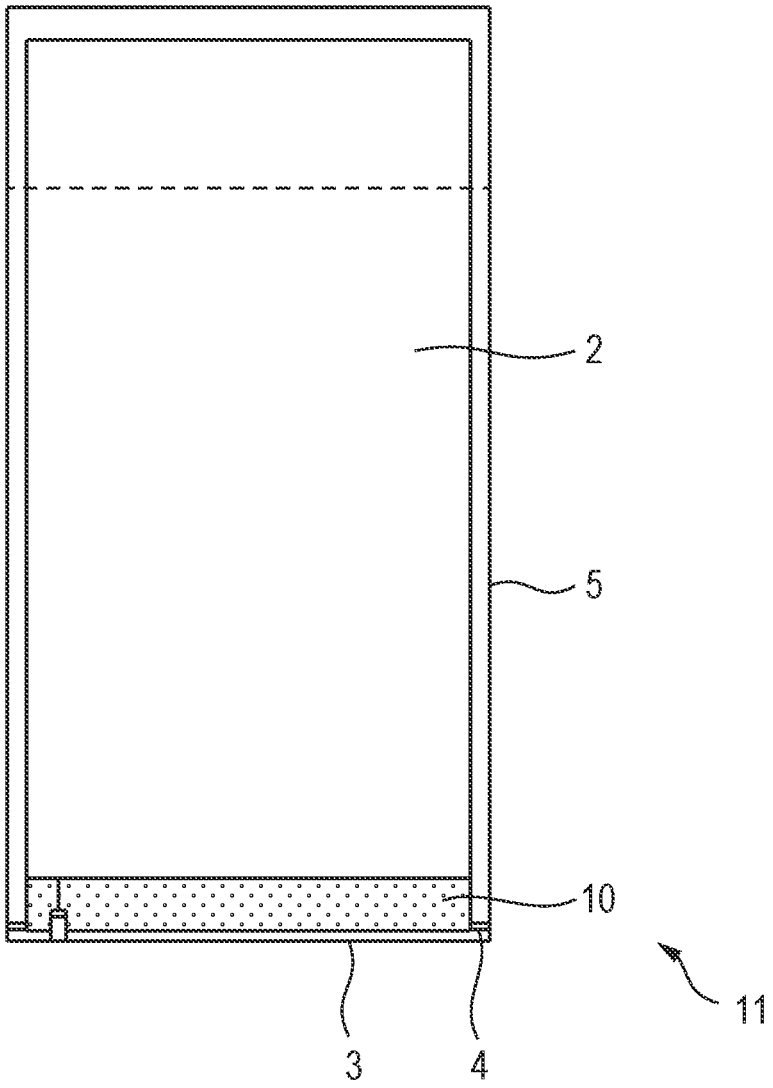
FIG. 4 is a plan view of a multiband antenna according to a second embodiment.

FIG. 4 is a plan view of the multiband antenna according to the second embodiment. A multiband antenna 11 according to the second embodiment includes the ground conductor 2, the first conductor 3, the second conductor 4, and the third conductor 5. The multiband antenna 11 according to the second embodiment is different from the multiband antenna 1 according to the first embodiment in the shape of the third conductor 5. Thus, the difference of the third conductor 5 will be described below.

In the multiband antenna 11 according to the second embodiment, the third conductor 5 is formed to surround the outer periphery of the ground conductor 2 on the surface of the substrate 10 on which the ground conductor 2 is provided. Thus, the third conductor 5 may be a portion of the frame of the radio communication terminal in which the multiband antenna 11 is to be mounted. In addition, the third conductor 5 may be formed such that a portion of the third conductor 5 overlaps with the ground conductor 2 when viewed from the front side of the ground conductor 2. For example, as represented by a dotted line in FIG. 4, the third conductor 5 may be formed such that a portion of the third conductor 5 on the opposite side to the side of the third conductor 5 connected to the first conductor 3 overlaps with the ground conductor 2.

Figure 5:
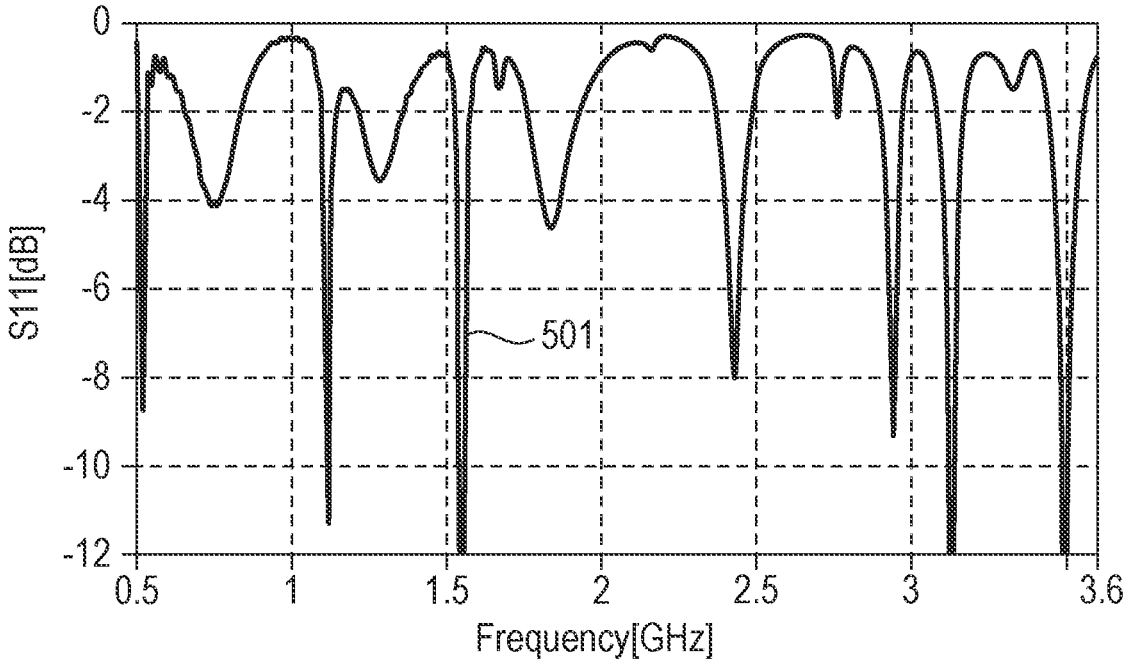
FIG. 5 is a graph illustrating a frequency characteristic of an $S_{11}$ parameter of the multiband antenna according to the second embodiment.

FIG. 5 is a graph illustrating a frequency characteristic of an $S_{11}$ parameter of the multiband antenna 11. In FIG. 5, the horizontal axis represents the frequency [GHz], and the vertical axis represents the $S_{11}$ parameter [dB]. A graph 501 represents the frequency characteristic of the $S_{11}$ parameter of the multiband antenna 11 which is obtained by the electromagnetic field simulation. In addition, in the electromagnetic field simulation, the distance between the third conductor 5 and the ground conductor 2 is set to 3 mm over the entire third conductor 5. The dimensions of the other parts of the multiband antenna 11 are set to be the same as those illustrated in FIG. 2.

As represented by the graph 501, it may be understood that since the $S_{11}$ parameter has the minimum value of −3 dB or less in the 1.5 GHz band as well, in addition to the 800 MHz band and the 2 GHz band, the multiband antenna 11 according to the second embodiment may resonate in the 1.5 GHz band as well, in addition to the 800 MHz band and the 2 GHz band. From this result, it may be understood that the multiband antenna 11 according to the second embodiment is usable in the 1.5 GHz band as well, in addition to the 800 MHz band and the 2 GHz band.

In addition, as represented by the graph 501, there exist frequency bands in which the $S_{11}$ parameter has the minimum value of −3 dB or less, other than the 800 MHz band, the 1.5 GHz band, and the 2 GHz band. Thus, the multiband antenna 11 is usable in the corresponding frequency bands as well. This is because the first conductor and the third conductor form the loop, and thus, the multiband antenna 11 may also resonate with radio waves having wavelengths corresponding to the frequency bands other than the 800 MHz band, the 1.5 GHz band, and the 2 GHz band.

Meanwhile, when the multiband antenna 11 is not used in the frequency bands other than the 800 MHz band, the 1.5 GHz band, and the 2 GHz band, it is preferable that the multiband antenna 11 does not resonate in the frequency bands.

Figure 6:
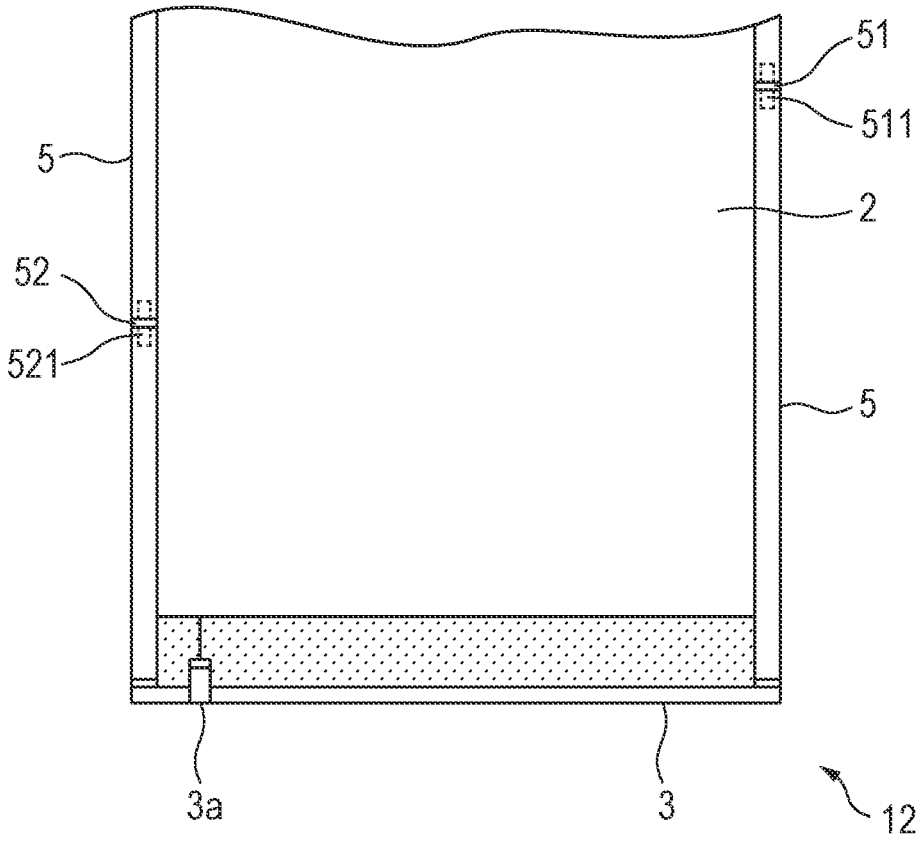
FIG. 6 is a partial enlarged view of a multiband antenna according to a modification of the second embodiment.

FIG. 6 is a partial enlarged view of a multiband antenna 12 according to a modification of the second embodiment. The multiband antenna 12 according to the modification is different from the multiband antenna 11 according to the second embodiment in that two short-circuit points 51 and 52 are provided in the third conductor 5 so as to be short-circuited with the ground conductor 2 in the modification.

The short-circuit point 51 is provided at a position away from the power feeding point 3*a* along the first conductor 3 and the third conductor 5 by the electrical length corresponding to the first frequency. Meanwhile, the short-circuit point 52 is provided at a position away from the power feeding point 3*a* along the first conductor 3 and the third conductor 5 in the opposite direction to the direction toward the short-circuiting point 51 by the electrical length corresponding to the second frequency. For example, when the first frequency is 800 MHz, the short-circuit point 51 is provided 123 mm away from the power-feeding point 3*a*. In addition, when the second frequency is 2 GHz, the short-circuit point 52 is provided 50 mm away from the power-feeding point 3*a*.

When the short-circuit points are provided, resonance with radio waves other than the radio waves having the first frequency and the radio waves having the second frequency is suppressed in the first conductor 3 and the third conductor 5. Thus, the multiband antenna 12 may suppress the resonance in frequency bands other than the first frequency, the second frequency, and the third frequency at which the first conductor 3 and the second conductor 4 resonate.

Figure 7:
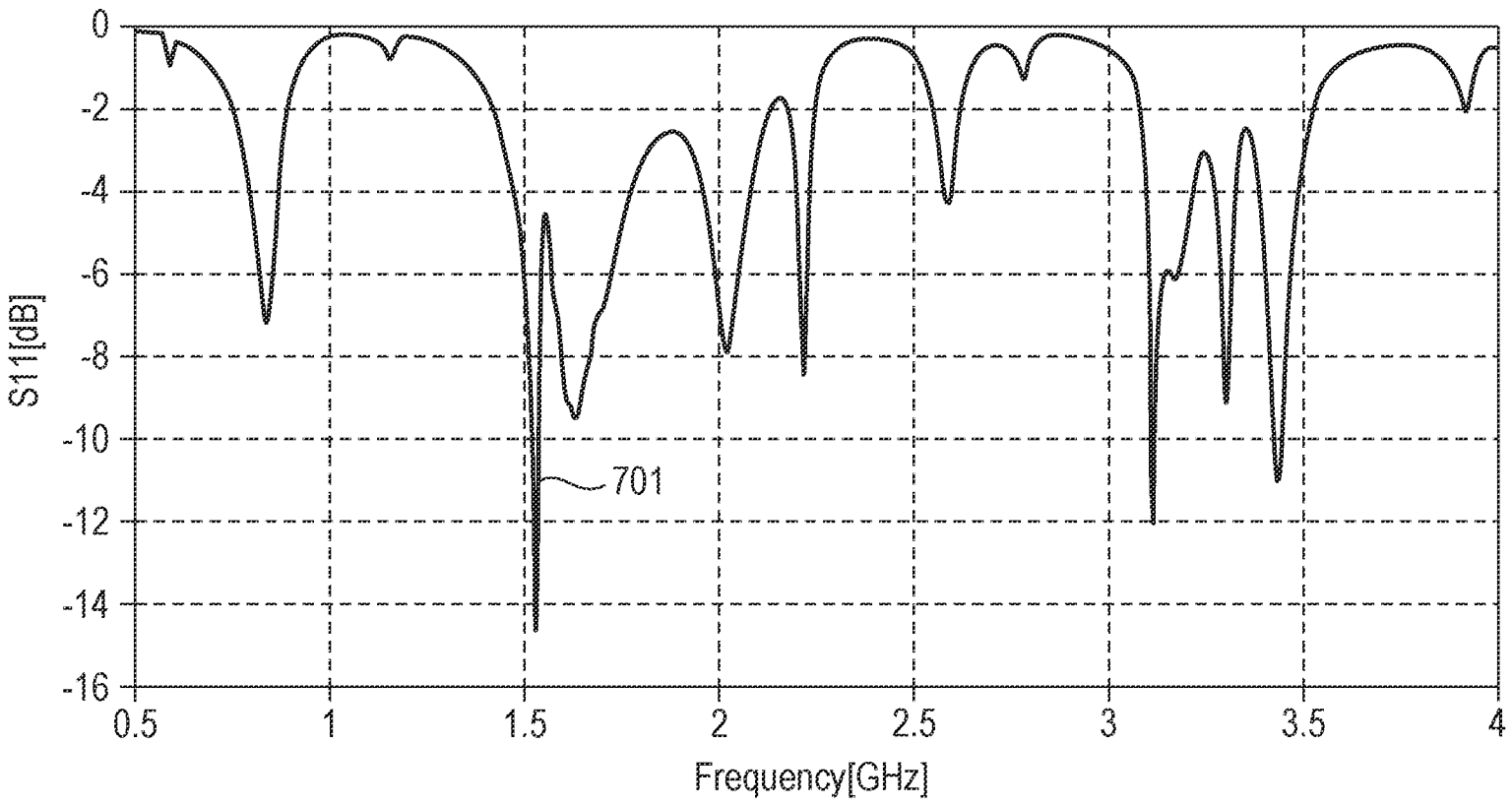
FIG. 7 is a graph illustrating a frequency characteristic of an $S_{11}$ parameter of the multiband antenna according to the modification.

FIG. 7 is a graph illustrating a frequency characteristic of an $S_{11}$ parameter of the multiband antenna 12 according to the present modification. In FIG. 7, the horizontal axis represents the frequency [GHz], and the vertical axis represents the $S_{11}$ parameter [dB]. A graph 701 represents the frequency characteristic of the $S_{11}$ parameter of the multiband antenna 12 which is obtained by the electromagnetic field simulation. In addition, except that the short-circuit point 51 is provided 123 mm away from the power-feeding point 3*a*, and the short-circuit point 52 is provided 50 mm away from the power-feeding point 3*a*, the dimensions of the other parts are set to be the same as those used in the simulation of FIG. 5.

As represented by the graph 701, it may be understood that the number of frequencies at which the $S_{11}$ parameter has the minimum value of −3 dB or less is reduced in the frequency bands of 3 GHz or less, as compared with the frequency characteristic of the $S_{11}$ parameter of the multiband antenna 11. Meanwhile, in the 800 MHz band, the 1.5 GHz band, and the 2 GHz band, the $S_{11}$ parameter has the minimum value of −3 dB or less. Accordingly, it may be understood that in the multiband antenna 12, the resonance is suppressed in frequency bands other than the first frequency, the second frequency, and the third frequency at which the first conductor 3 and the second conductor 4 resonate.

Figure 8:
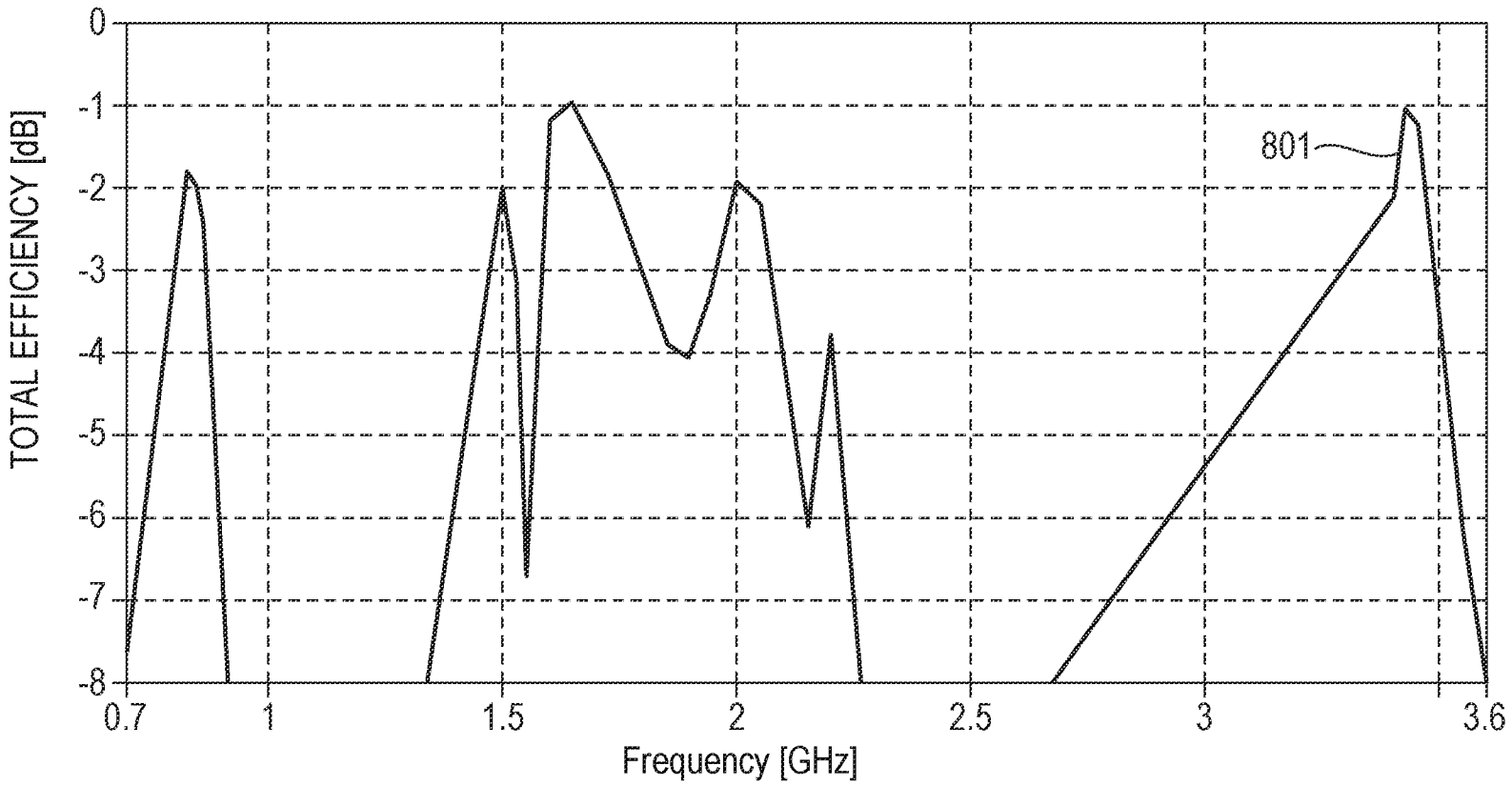
FIG. 8 is a graph illustrating a frequency characteristic of a total efficiency of the multiband antenna according to the modification.

FIG. 8 is a graph illustrating a frequency characteristic of a total efficiency of the multiband antenna 12. In FIG. 8, the horizontal axis represents the frequency [GHz], and the vertical axis represents the total efficiency [dB]. In addition, the total efficiency represents the ratio of power emitted as radio waves out of power input to the multiband antenna. A graph 801 represents the frequency characteristic of the total efficiency of the multiband antenna 12 which is obtained by the electromagnetic field simulation.

As represented in the graph 801, it may be understood that since the total efficiency is higher than −3 [dB] in the 1.5 GHz as well, in addition to the 800 MHz band and the 2 GHz band, a good radiation characteristic is obtained in the frequency bands, for the multiband antenna 12.

In addition, in the multiband antenna according to each embodiment or modification described above, the width of the slit 6 formed between the first conductor 3 and the second conductor 4 (i.e., a distance W between the first conductor 3 and the second conductor 4 as illustrated in FIG. 6) may be adjusted according to the third frequency.

Figure 9:
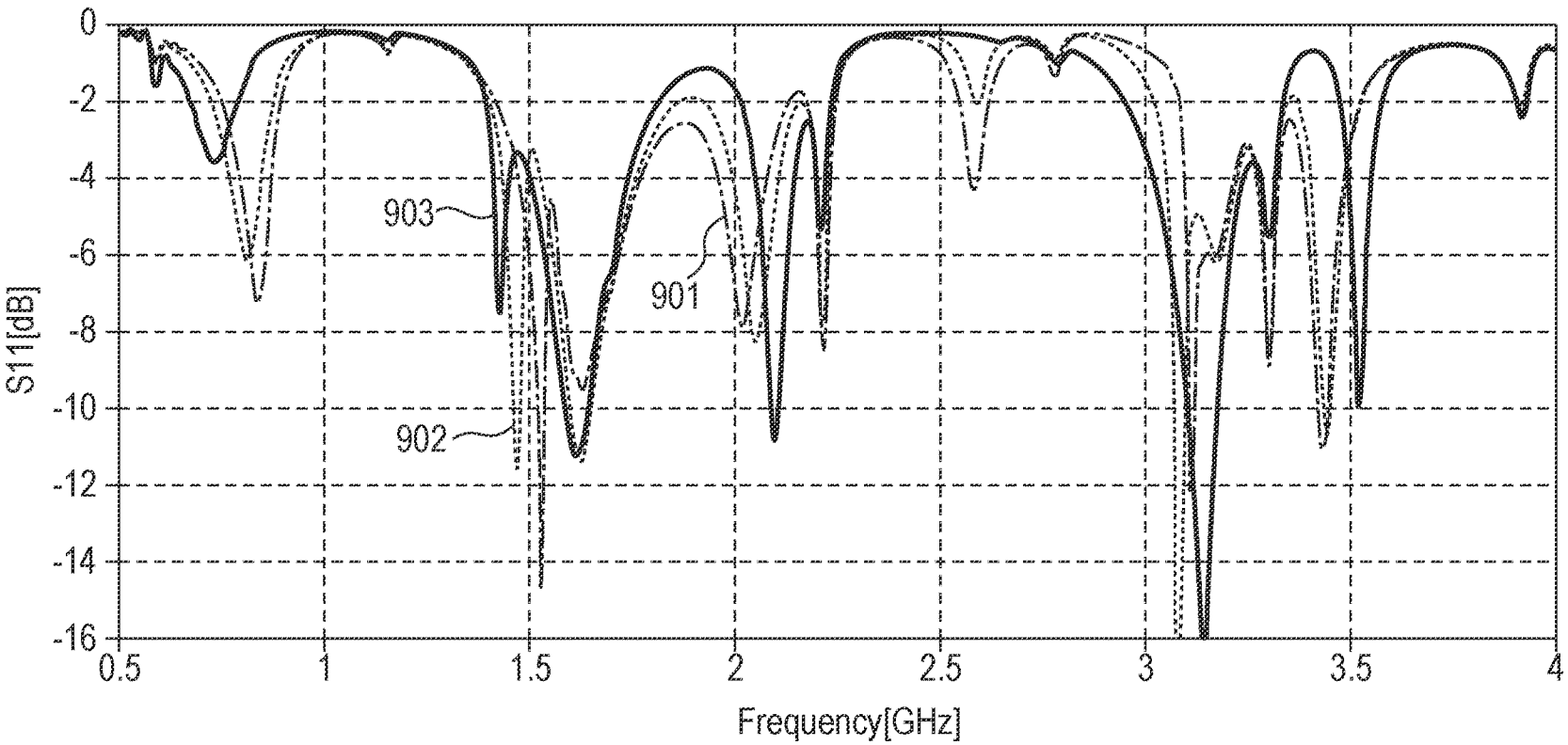
FIG. 9 is a graph illustrating a frequency characteristic of an $S_{11}$ parameter when a position of a second conductor is changed so as to change a width of a slit, in the multiband antenna according to the modification of the second embodiment.

FIG. 9 is a graph illustrating a frequency characteristic of an $S_{11}$ parameter in a case where the position of the second conductor 4 is changed such that the width of the slit 6 becomes 2 mm, 6 mm, and 14 mm, respectively, in the multiband antenna 12 according to the modification of the second embodiment. In FIG. 9, the horizontal axis represents the frequency [GHz], and the vertical axis represents the $S_{11}$ parameter [dB]. A graph 901 represents the frequency characteristic of the $S_{11}$ parameter of the multiband antenna 12 which is obtained by the electromagnetic field simulation, in a case where the width of the slit 6 is 2 mm. A graph 902 represents the frequency characteristic of the $S_{11}$ parameter of the multiband antenna 12 which is obtained by the electromagnetic field simulation, in a case where the width of the slit 6 is 6 mm. In addition, a graph 903 represents the frequency characteristic of the $S_{11}$ parameter of the multiband antenna 12 which is obtained by the electromagnetic field simulation, in a case where the width of the slit 6 is 14 mm. In addition, in this simulation, the shape of the multiband antenna 12 except for the position of the second conductor 4 is set to be the same as the shape of the multiband antenna 12 used in the simulation of FIG. 7.

As illustrated in the graphs 901 to 903, it may be understood that as the width of the slit 6 becomes wide, the third frequency at which the multiband antenna resonates is lowered. This is because the loop formed by the first conductor 3 and the second conductor 4 to surround the slit 6 becomes longer as the width of the slit 6 becomes wider, and the electrostatic capacity between the second conductor 4 and the ground conductor 2 increases as the second conductor 4 and the ground conductor 2 are close to each other.

In this way, in the multiband antenna, the third frequency at which the multiband antenna resonates may be adjusted by adjusting the width of the slit 6.

In addition, on the lateral surface of the radio communication terminal, a port for connecting the radio communication terminal to another device or an insertion port for an insertion of, for example, a memory card may be provided. In this case, in order to provide the port or insertion port, a notch may be formed in the first conductor 3 of the multiband antenna.

Figure 10:
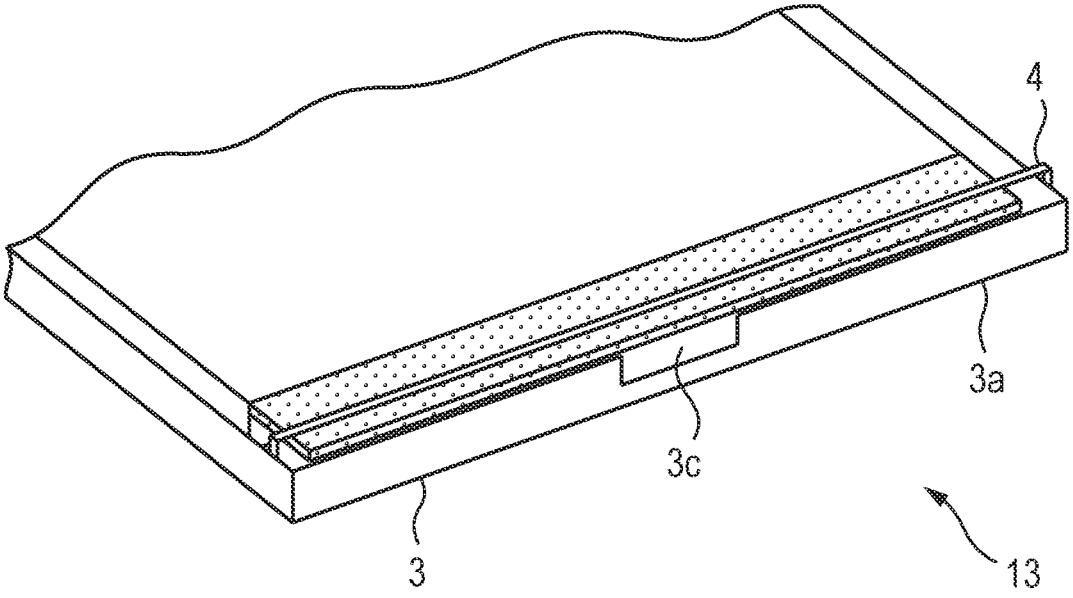
FIG. 10 is a partial perspective view of a modification of a multiband antenna when viewed from the side of a first conductor, according to another modification of the second embodiment.

FIG. 10 is a partial perspective view of a modification of a multiband antenna when viewed from the side of the first conductor 3, according to another modification of the second embodiment. A multiband antenna 13 according to the present modification is different from the multiband antenna 12 illustrated in FIG. 6 in that a notch 3*c* is formed in the first conductor 3 in the present modification. In this example, the notch 3*c* is formed at substantially the center of the first conductor 3 in the longitudinal direction thereof on the side of the second conductor 4. The longitudinal direction of the notch 3*c* is parallel with the longitudinal direction of the first conductor 3. In addition, the notch 3*c* may be formed on the opposite side to the second conductor 4, that is, on the side where the protrusion 3*b* is provided. In addition, the notch 3*c* may be formed at a position other than substantially the center of the first conductor 3 in the longitudinal direction thereof, for example, a position closer to the power feeding point 3*a* than the center of the first conductor 3 in the longitudinal direction thereof, or a position farther from the power feeding point 3*a* than the center of the first conductor 3 in the longitudinal direction thereof.

Figure 11:
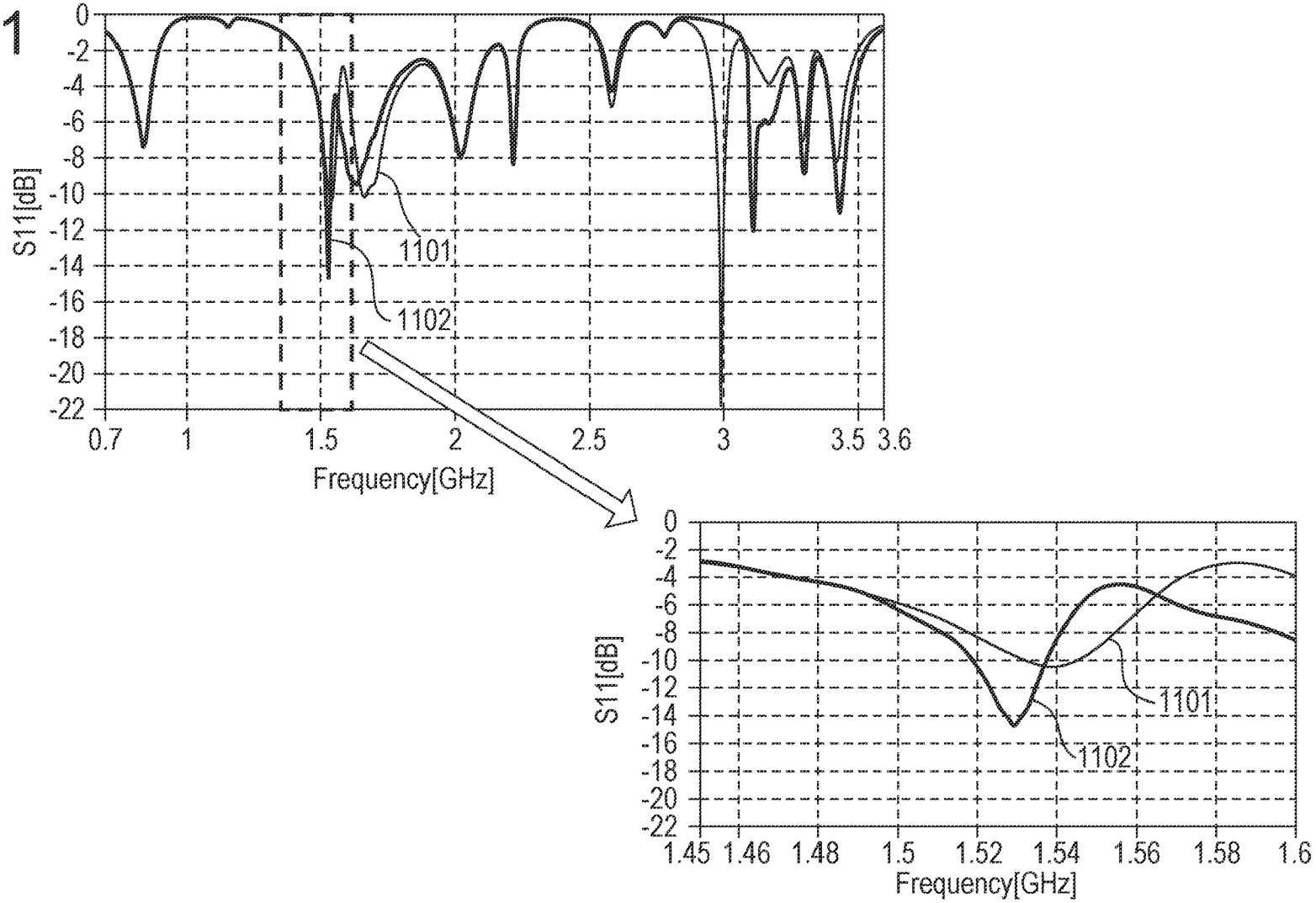
FIG. 11 is a graph illustrating a frequency characteristic of an $S_{11}$ parameter of the multiband antenna according to the another modification of the second embodiment.

FIG. 11 is a graph illustrating a frequency characteristic of an $S_{11}$ parameter of the multiband antenna 13 according to the present modification. In FIG. 11, the horizontal axis represents the frequency [GHz], and the vertical axis represents the $S_{11}$ parameter [dB]. A graph 1101 represents the frequency characteristic of the $S_{11}$ parameter of the multiband antenna 13 which is obtained by the electromagnetic field simulation. In addition, a graph 1102, as a comparison, represents the frequency characteristic of the $S_{11}$ parameter of the multiband antenna 12. In addition, in this example, the longitudinal length of the notch 3*c* is set to 11 mm, and the length of the notch 3*c* in the short direction thereof (i.e., the width direction of the first conductor 3) is set to 2.5 mm. In addition, it is assumed that the center of the notch 3*c* in the longitudinal direction thereof coincides with the center of the first conductor 3 in the longitudinal direction thereof. The dimensions of the other parts of the multiband antenna 13 are set to be the same as those illustrated in the simulation of FIG. 5.

As represented in the graphs 1101 and 1102, when the notch 3*c* is formed, the frequency at which the $S_{11}$ parameter becomes the minimum value shifts slightly to the side of the high frequency, and the width of the frequency at which the $S_{11}$ parameter becomes a sufficiently small value is wide, in the 1.5 GHz. This is because the notch 3*c* is formed at the position where the electric field becomes relatively strong with respect to the frequency of the 1.5 GHz band in the loop around the slit 6. Thus, by shifting the position of the notch 3*c* along the longitudinal direction of the first conductor 3 by a distance corresponding to approximately ¼ of the electrical length corresponding to the third frequency, the variation of the frequency characteristic of the $S_{11}$ parameter in a case where the notch 3*c* is not formed is suppressed in the 1.5 GHz band as well.

In addition, the notch described above may be formed in the third conductor 5, rather than the first conductor 3. In this case, as compared with the case where the notch 3*c* is formed in the first conductor 3, the variation of the frequency characteristic of the $S_{11}$ parameter with respect to the third frequency is suppressed.

In addition, in the multiband antenna according to each embodiment or modification described above, the second conductor 4 may be connected to the first conductor 3 or the third conductor 5 via a resonance frequency adjusting element.

Figure 12:
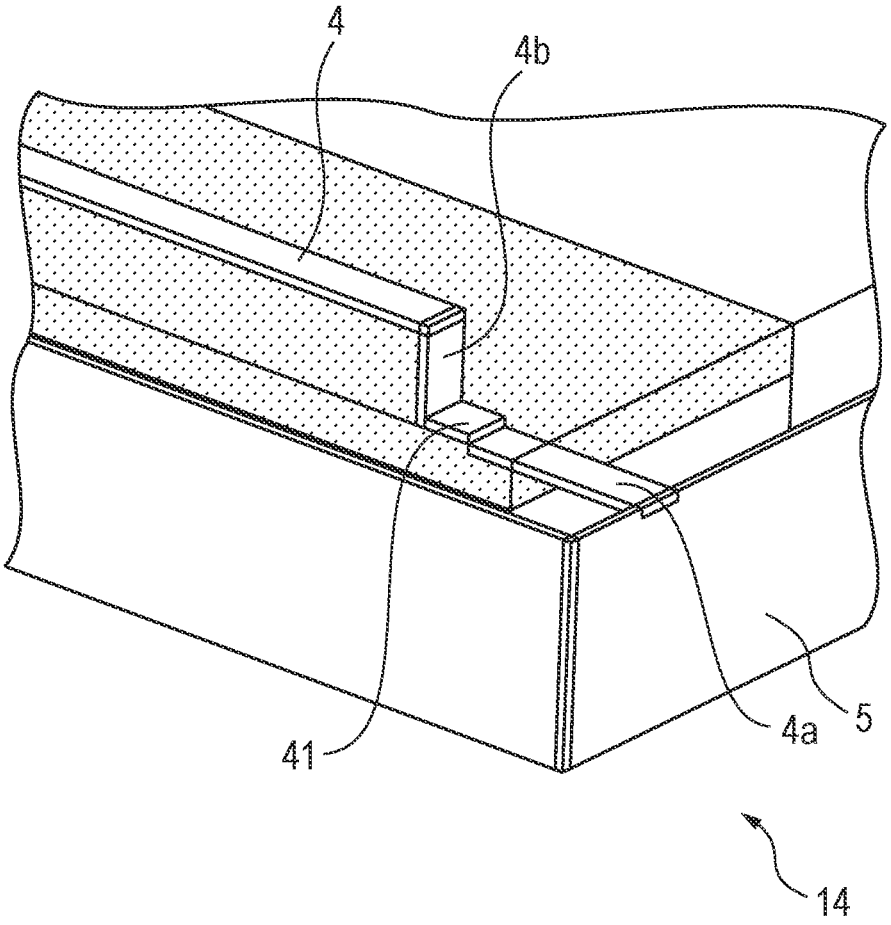
FIG. 12 is a partial enlarged perspective view of an end portion of a second conductor of a multiband antenna according to still another modification.

FIG. 12 is a partial enlarged perspective view of the end portion of the second conductor 4 of the multiband antenna according to the present modification. A multiband antenna 14 according to the present modification is different from the multiband antenna 12 according to the second embodiment in the structure of the end portion of the second conductor 4 and the presence of the resonance frequency adjusting element. In addition, the structure of the end portion of the second conductor 4 and the resonance frequency adjusting element of the multiband antenna 14 may be adopted in a multiband antenna according to the other embodiments or modifications described above.

In the present modification, a tab 4*a* is provided at the end portion of the second conductor 4 to be connected to the third conductor 5 at one end of the tab 4*a* and extend substantially parallel with the first conductor 3 toward the side of the main body of the second conductor 4. Further, a plate-shaped spring contact point 4*b* is provided at the end portion of the main body of the second conductor 4, and is formed to generate the stress toward the side of the tab 4*a*. Further, a resonance frequency adjusting element 41 is provided between the tab 4*a* and the spring contact point 4*b*.

The resonance frequency adjusting element 41 is to adjust the third frequency, and may be, for example, a capacitor having a predetermined electrostatic capacity, an inductor having a predetermined inductance, a jumper which is a zero ohm resistor, or a circuit which is a combination thereof.

The frequency at which the loop formed around the slit 6 resonates, that is, the third frequency fluctuates according to the electrostatic capacity or the inductance of the resonance frequency adjusting element 41. Thus, in the multiband antenna 14 according to the present modification, by providing the resonance frequency adjusting element 41, it is possible to adjust the third frequency independently from the first frequency and the second frequency. Thus, for example, when the second conductor 4 is formed of sheet metal or formed as a conductor which is provided in the housing of the radio communication terminal, separately from the first conductor 3 and the third conductor 5, the third frequency is also set to a desired frequency in the multiband antenna 14.

According to still another modification, the resonance frequency adjusting element may be provided at at least one side of the two short-circuit points 51 and 52 where the third conductor 5 is short-circuited with the ground conductor 2. For example, as indicated by dotted lines in FIG. 6, a resonance frequency adjusting element 511 is provided at the short-circuit point 51, and a resonance frequency adjusting element 521 is provided at the short-circuit point 52. In this case, by using the resonance frequency adjusting elements 511 and 521 each having an appropriate electrostatic capacity or inductance, the first frequency or the second frequency is set to a desired frequency.

In addition, depending on a radio communication terminal, multiple antennas may be used in the same frequency band in order to cope with, for example, multiple-input and multiple-output (MIMO). Thus, multiple multiband antennas according to each embodiment or modification described above may be mounted on a single radio communication terminal.

Figure 13B:
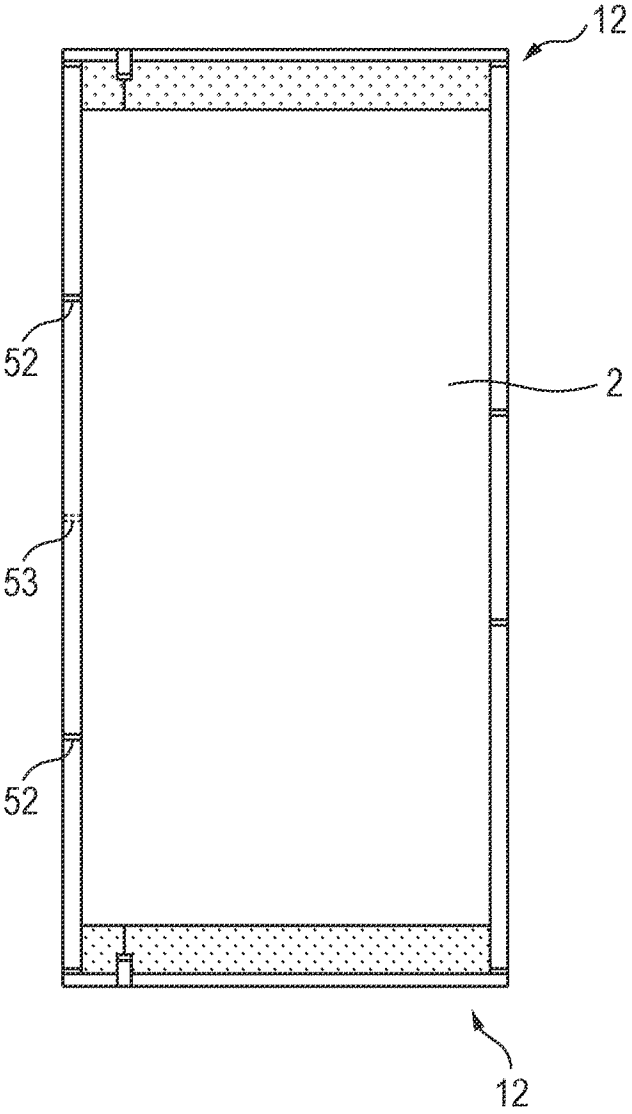
FIGS. 13A and 13B each are a plan view of two multiband antennas in a case where the respective multiband antennas are mounted on a single radio communication terminal.
Figure 13A:
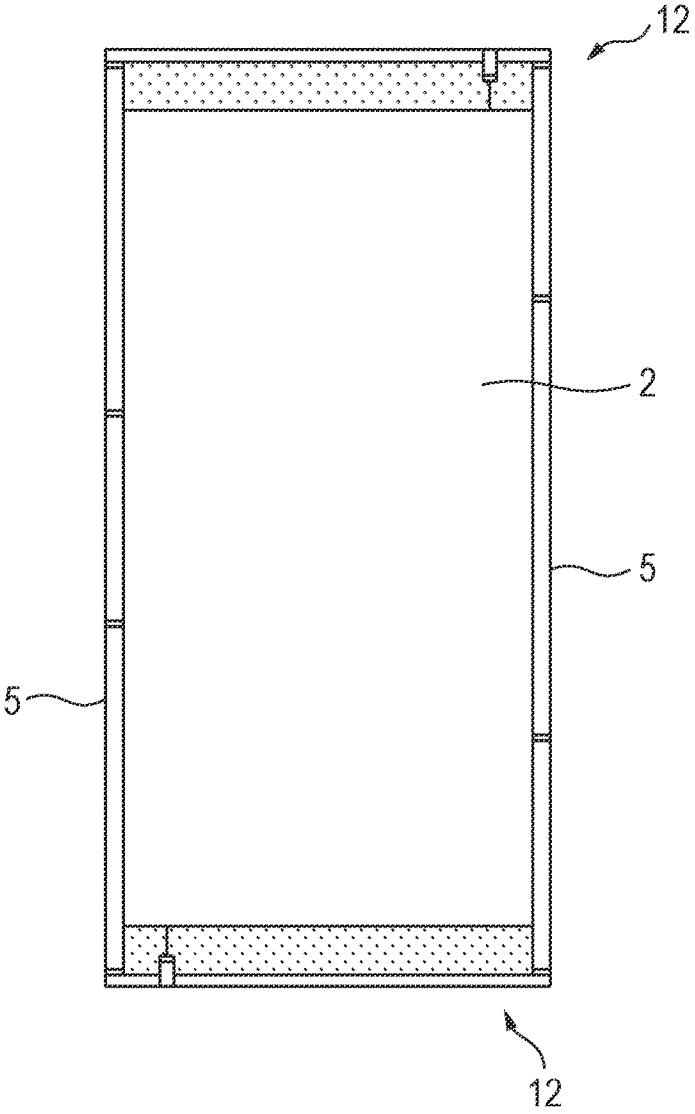

FIGS. 13A and 13B are plan views of two multiband antennas in a case where two multiband antennas 12 are mounted in a single radio communication terminal. In the example illustrated in FIG. 13A, the two multiband antennas 12 are arranged to be central point symmetrical with each other about the center of the ground conductor 2. Meanwhile, in the example illustrated in FIG. 13B, the two multiband antennas 12 are arranged to be line symmetrical with each other about the bisector of the ground conductor 2 in the longitudinal direction thereof. In addition, in the examples illustrated in FIGS. 13A and 13B, the ground conductor 2 and the third conductor 5 are shared between the two multiband antennas 12. In addition, the ground conductor 2 and the third conductor 5 may be provided for each of the two multiband antennas. In addition, each multiband antenna 12 has a matching circuit (parallel inductor 11 nH and series capacitor 1.6 pF) at a power feeding point.

Figure 14:
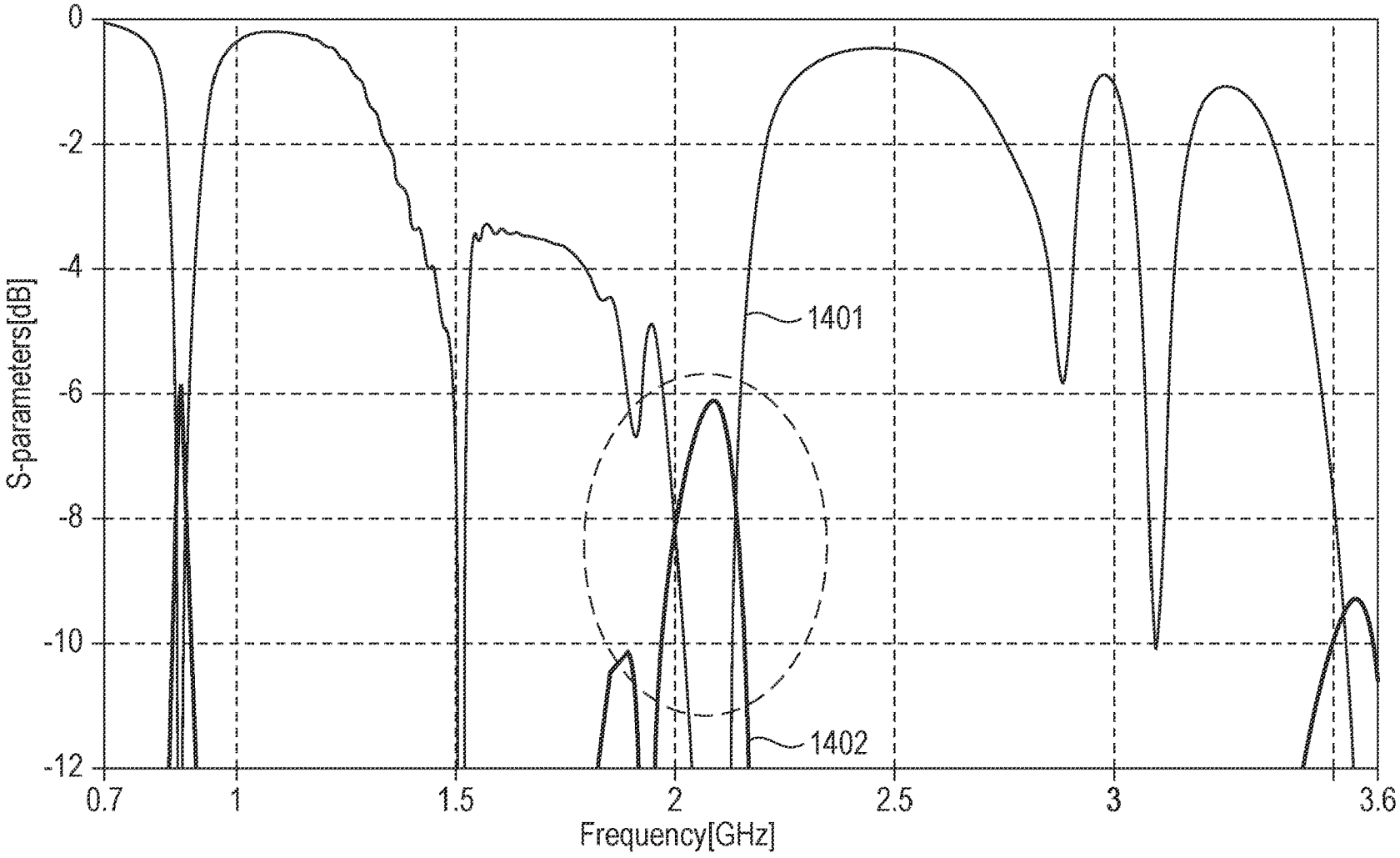
FIG. 14 is a graph illustrating a frequency characteristic of an S parameter in a case where the two multiband antennas are arranged to be point symmetrical with each other as illustrated in FIG. 13A.

FIG. 14 is a graph illustrating a frequency characteristic of an S parameter in a case where the two multiband antennas are arranged to be point symmetrical with each other as illustrated in FIG. 13A. In FIG. 14, the horizontal axis represents the frequency [GHz], and the vertical axis represents the S parameter [dB]. A graph 1401 represents a frequency characteristic of an $S_{11}$ parameter of the multiband antennas which is obtained by the electromagnetic field simulation. In addition, a graph 1402 represents a frequency characteristic of an $S_{12}$ parameter of the multiband antennas which is obtained by the electromagnetic field simulation. In addition, in the electromagnetic field simulation, the dimensions of the respective parts of each multiband antenna 12 are set to be the same as those in the electromagnetic field simulation illustrated in FIG. 7. In addition, the distance between the short-circuit point 51 provided in the third conductor 5 for one multiband antenna 12 and the short-circuited point 52 provided in the third conductor 5 for the other multiband antenna 12 is set to 53 mm.

As represented in the graph 1401, in this example as well, it may be understood that since the $S_{11}$ parameter has the minimum value in the 800 MHz band, the 1.5 GHz band, and the 2 GHz band, the multiband antennas 12 may resonate in these frequency bands. Meanwhile, as represented in the graph 1402, it may be understood that since the $S_{12}$ parameter has a maximum value of approximately −6 dB in the 2 GHz band, the two multiband antennas 12 are electromagnetically coupled to each other in the 2 GHz band.

Figure 15:
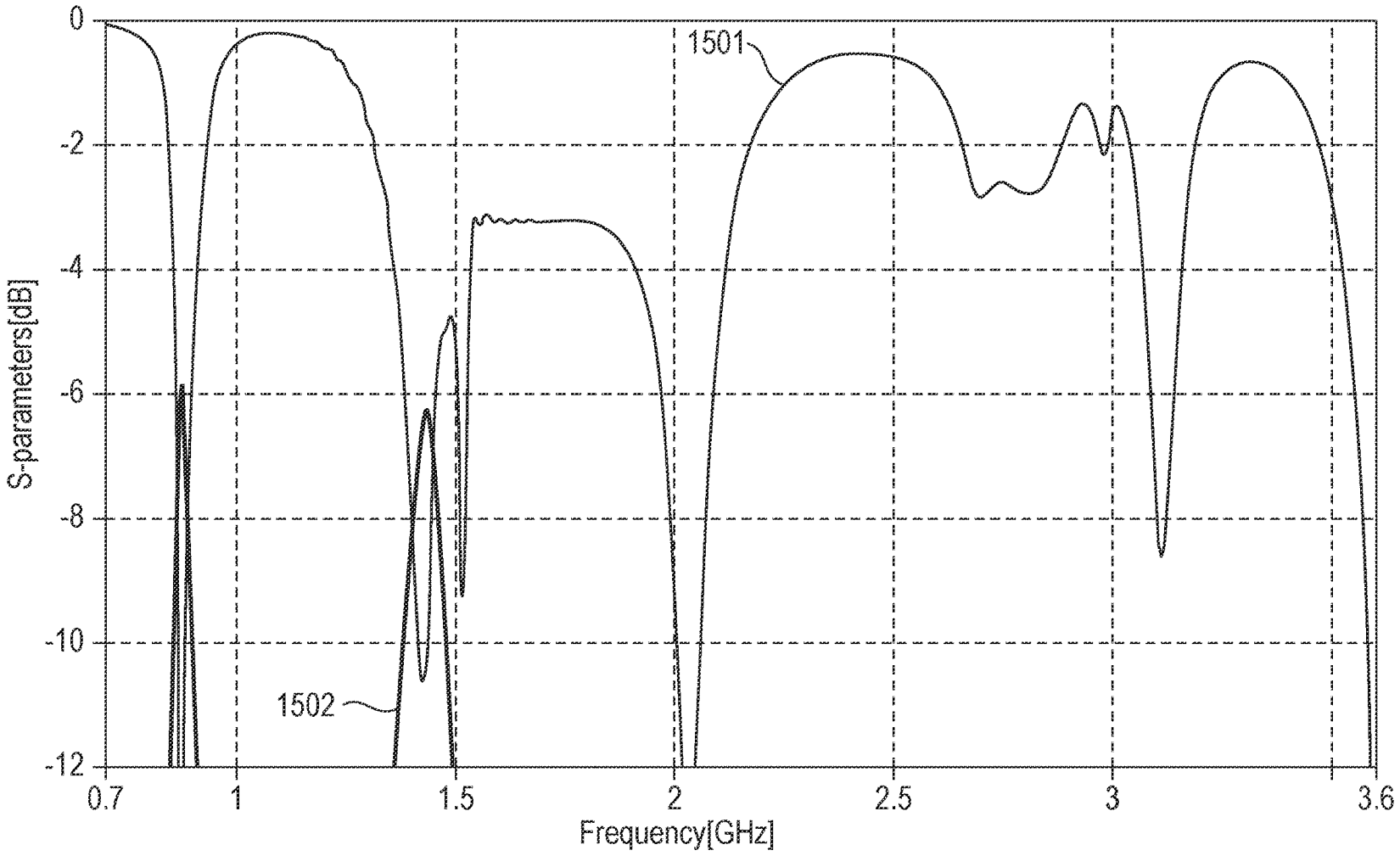
FIG. 15 is a graph illustrating a frequency characteristic of an S parameter in a case where the two multiband antennas are arranged to be line symmetrical with each other as illustrated in FIG. 13B.

FIG. 15 is a graph illustrating a frequency characteristic of an S parameter in a case where the two multiband antennas 12 are arranged to be line symmetrical with each other as illustrated in FIG. 13B. In FIG. 15, the horizontal axis represents the frequency [GHz], and the vertical axis represents the S parameter [dB]. A graph 1501 represents a frequency characteristic of an $S_{11}$ parameter of the multiband antennas 12 which is obtained by the electromagnetic field simulation. In addition, a graph 1502 represents a frequency characteristic of an $S_{12}$ parameter of the multiband antennas 12 which is obtained by the electromagnetic field simulation. In addition, in the electromagnetic field simulation, the dimensions of the respective parts of each multiband antenna 12 are set to be the same as those used in the electromagnetic field simulation illustrated in FIG. 7. In addition, the distance between the short-circuit point 51 provided in the third conductor 5 for one multiband antenna 12 and the short-circuit point 51 provided in the third conductor 5 for the other multiband antenna 12 is set to 34 mm. Further, the distance between the short-circuit point 52 provided in the third conductor 5 for one multiband antenna 12 and the short-circuit point 52 provided in the third conductor 5 for the other multiband antenna 12 is set to 72 mm.

As represented in the graph 1501, in this example as well, it may be understood that since the $S_{11}$ parameter has the minimum value in the 800 MHz band, the 1.5 GHz band, and the 2 GHz band, the multiband antennas 12 may resonate in these frequency bands. Meanwhile, as represented in the graph 1502, it may be understood that since the $S_{12}$ parameter does not have the maximum value in the 2 GHz band, the two multiband antennas 12 are not electromagnetically coupled to each other in the 2 GHz band.

This is because in the arrangement of the two multiband antennas 12 illustrated in FIG. 13A, the length between the respective power feeding points 3*a* of the two multiband antennas 12 along the first conductor 3 and the third conductor 5 is approximately an integer multiple of ½ of the electrical length corresponding to the 2 GHz band. Thus, the currents flowing through the two respective multiband antennas 12 strengthen each other with respect to the radio waves of the 2 GHz band. Meanwhile, in the arrangement of the two multiband antennas 12 illustrated in FIG. 13B, the length between the power feeding points 3*a* of the two respective multiband antennas 12 along the first conductor 3 and the third conductor 5 is different from the integer multiple of ½ of the electrical length corresponding to the 2 GHz band. Thus, the currents flowing through the two multiband antennas 12 weaken each other with respect to the radio waves of the 2 GHz band.

However, as represented in the graphs 1501 and 1502, it may be understood that since the $S_{11}$ parameter has the minimum value and the $S_{12}$ parameter has the maximum value at approximately 1.4 GHz, unnecessary resonance occurs at approximately 1.4 GHz. This is because the loop formed by the third conductor 5 and the ground conductor 2 between the short-circuit points 52 of the two respective multiband antennas 12 resonates. Thus, as represented by dotted lines in FIG. 13B, by adding a short-circuit point 53 for short-circuiting the third conductor 5 and the ground conductor 2 with each other to the midpoint between the two short-circuited points 52, the loop is shortened so that the resonance is suppressed at 1.4 GHz.

Figure 16:
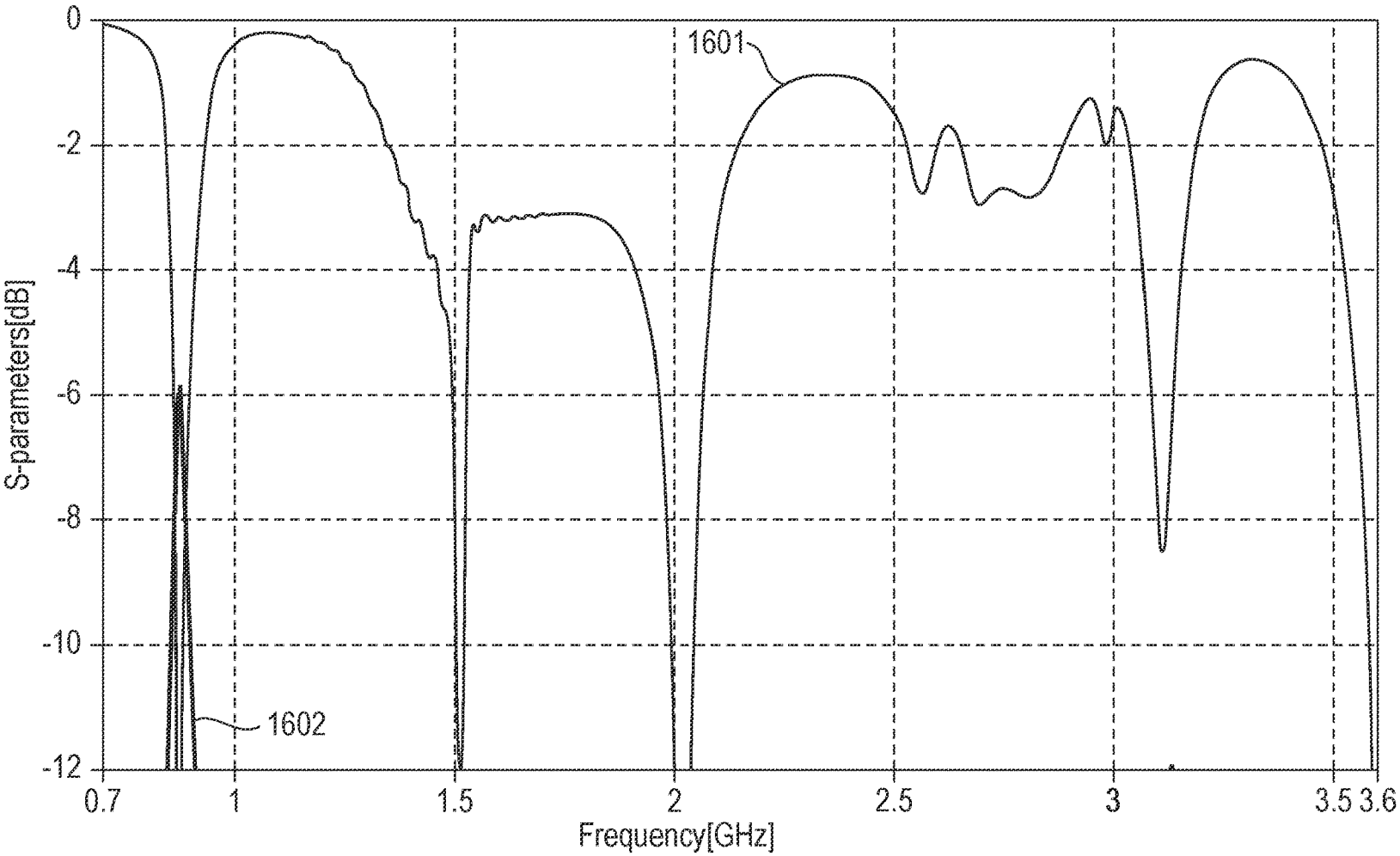
FIG. 16 is a graph illustrating a frequency characteristic of an S parameter in a case where the two multiband antennas are arranged to be line symmetrical with each other as illustrated in FIG. 13B, and another short-circuit point is provided at a midpoint between two short-circuit points.

FIG. 16 is a graph illustrating a frequency characteristic of an S parameter in a case where the two multiband antennas 12 are arranged to be line symmetrical with each other as illustrated in FIG. 13B, and the short-circuit point 53 is provided at the midpoint between the two short-circuit points 52. In FIG. 16, the horizontal axis represents the frequency [GHz], and the vertical axis represents the S parameter [dB]. A graph 1601 represents the frequency characteristic of the $S_{11}$ parameter of the multiband antennas 12 which is obtained by the electromagnetic field simulation. In addition, a graph 1602 represents the frequency characteristic of the $S_{12}$ parameter of the multiband antennas 12 which is obtained by the electromagnetic field simulation. In addition, in this electromagnetic field simulation, the dimensions of the respective parts of each multiband antenna 12 are set to be the same as those used for the electromagnetic field simulation illustrated in FIG. 15. The short-circuit point 53 is provided 36 mm away from each of the two short-circuit points 52.

As represented in the graphs 1601 and 1602, it may be understood that since both the $S_{11}$ parameter and the $S_{12}$ parameter do not have the maximum value at approximately 1.4 GHz, the multiband antenna 12 does not resonate at 1.4 GHz.

In this way, the two multiband antennas may be provided in a single radio communication terminal such that the two multiband antennas share the ground conductor 2 and the third conductor 5. In this case, the two multiband antennas are preferably arranged such that the distance between the power feeding points of the two respective multiband antennas along the first conductor 3 and the third conductor 5 is different from the integer multiple of ½ of the electrical length corresponding to the second frequency. Especially, the two multiband antennas are preferably arranged such that the distance between the power feeding points of the two respective multiband antennas along the first conductor 3 and the third conductor 5 becomes the length obtained by adding approximately ¼ of the electrical length corresponding to the second frequency to the integer multiple of ½ of the electrical length. As a result, the currents flowing through the two respective multiband antennas weaken each other, so that the electromagnetic coupling between the two multiband antennas is suppressed.

In addition, in the radio communication terminal, together with the multiband antenna according to each embodiment or modification, another antenna that resonates at a frequency different from the frequency used by the multiband antenna may be mounted.

Figure 17A:
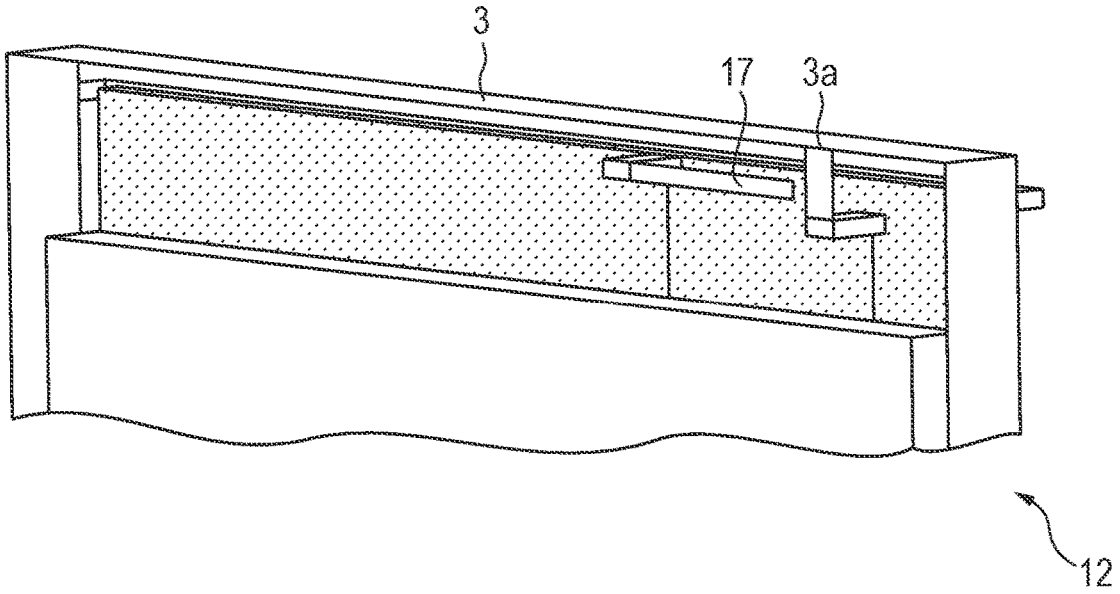
FIGS. 17A and 17B are schematic perspective views of a multiband antenna in a case where a monopole antenna is mounted together with each multiband antenna in a radio communication terminal.
Figure 17B:
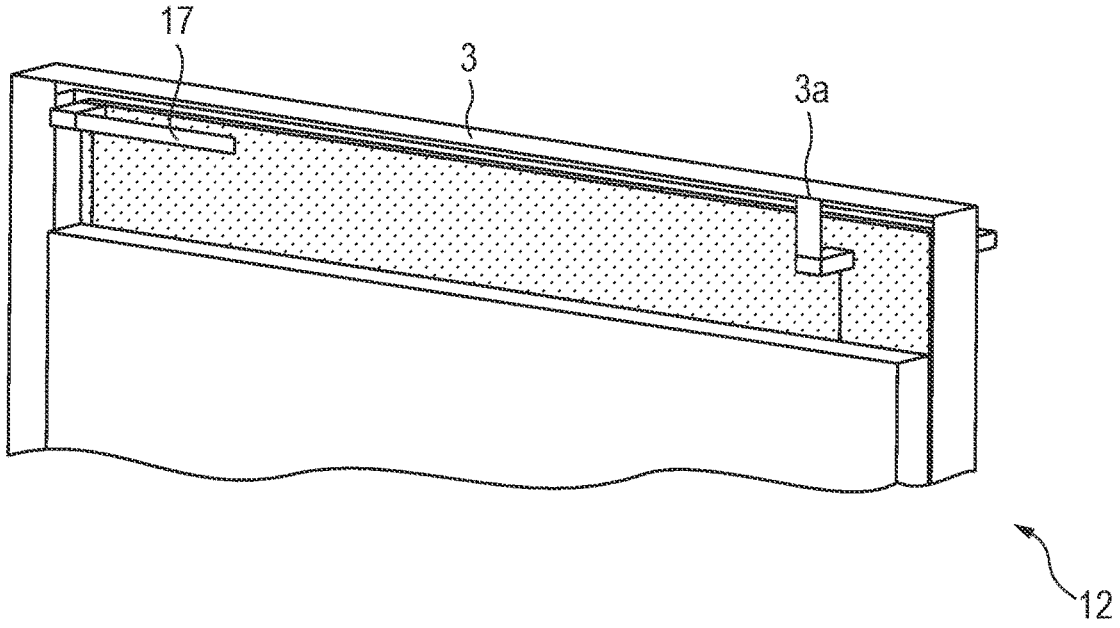

FIGS. 17A and 17B are schematic perspective views of the multiband antenna 12 in a case where a monopole antenna 17 is mounted together with the multiband antenna 12 in the radio communication terminal. In these examples, the monopole antenna 17 is disposed on the opposite side of the substrate to the second conductor 4, such that the tip portion of an L-shaped radiation conductor of the monopole antenna 17 is parallel with the longitudinal direction of the first conductor 3, and the root portion of the L-shaped radiation conductor of the monopole antenna 17 is provided on the substrate. The monopole antenna 17 is fed with power at the root portion of the radiation conductor. In the example illustrated in FIG. 17A, the monopole antenna 17 is disposed in the vicinity of the power feeding point 3*a* of the first conductor 3 of the multiband antenna 12. Meanwhile, in the example illustrated in FIG. 17B, the monopole antenna 17 is disposed in the vicinity of the end portion point of the first conductor 3 which is far from the power feeding point 3*a* of the first conductor 3 of the multiband antenna 12. In addition, the monopole antenna 17 may be mounted together with the two multiband antennas in the radio communication terminal as illustrated in FIG. 13A or 13B.

Figure 18:
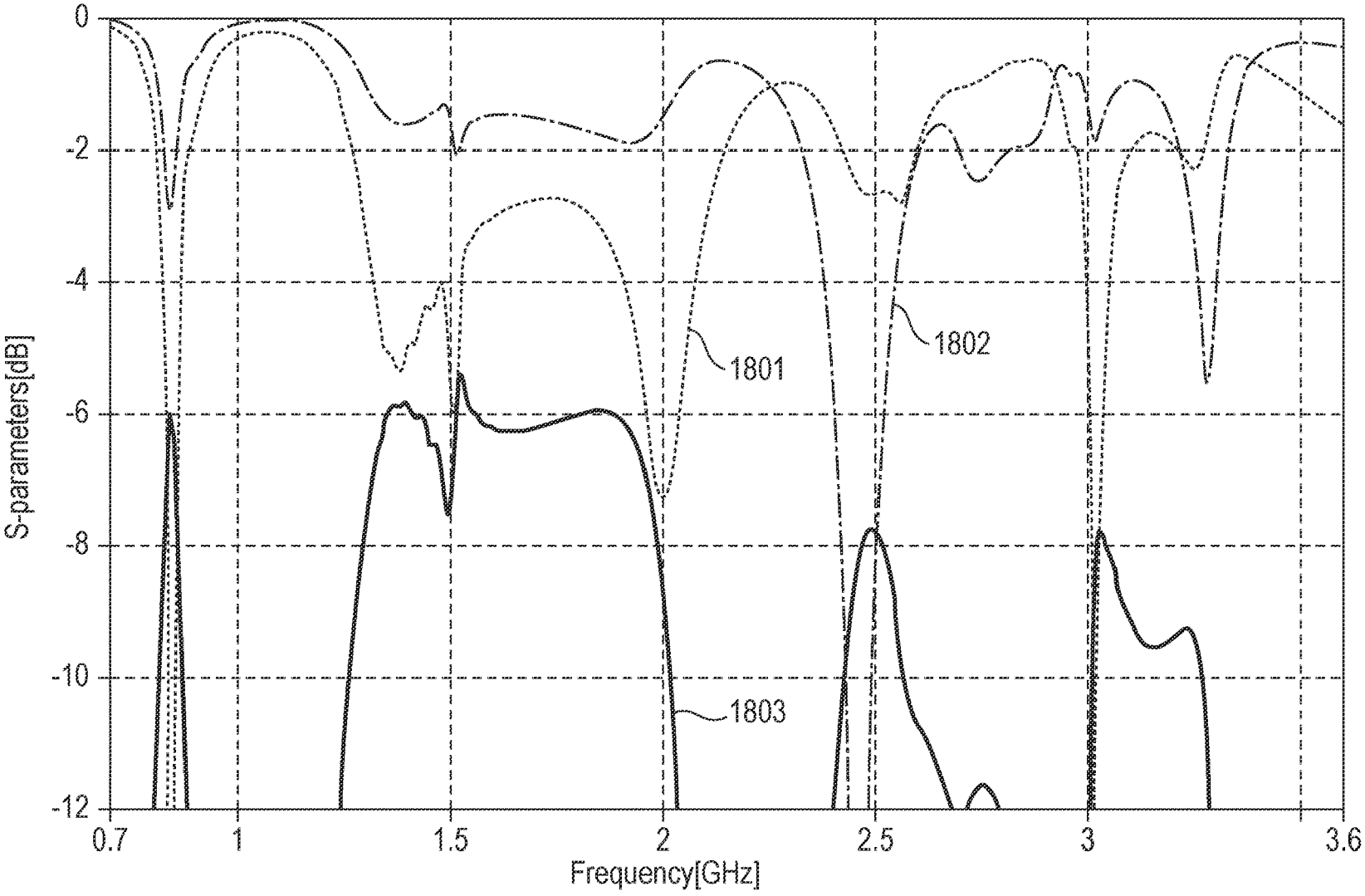
FIG. 18 is a graph illustrating a frequency characteristic of an S parameter of each antenna in a case where the monopole antenna is disposed in the vicinity of a power feeding point of the multiband antenna as illustrated in FIG. 17A.

FIG. 18 is a graph illustrating a frequency characteristic of an S parameter of each antenna in a case where the monopole antenna 17 is disposed in the vicinity of the power feeding point of the multiband antenna 12 as illustrated in FIG. 17A. In FIG. 18, the horizontal axis represents the frequency [GHz], and the vertical axis represents the S parameter [dB]. A graph 1801 represents a frequency characteristic of an $S_{22}$ parameter which is obtained by the electromagnetic field simulation and indicates a reflection against the input of the multiband antenna 12. In addition, a graph 1802 represents a frequency characteristic of an $S_{33}$ parameter which is obtained by the electromagnetic field simulation and indicates a reflection against the input of the monopole antenna 17. In addition, a graph 1803 represents a frequency characteristic of a $S_{32}$ parameter which is obtained by the electromagnetic field simulation and indicates a degree of influx into the multiband antenna 12 from the monopole antenna 17.

In addition, in this electromagnetic field simulation, the dimensions of the respective parts of the multiband antenna 12 are set to be the same as those used in the electromagnetic field simulation illustrated in FIG. 7. In addition, in order to make the monopole antenna 17 usable in the 2.4 GHz band, the length of the radiation conductor is set to 15 mm, and the height of the radiation conductor from the substrate is set to 3.5 mm. Further, the distance between the first conductor 3 and the monopole antenna 17 is set to 1.8 mm. In addition, the distance between the power feeding point of the multiband antenna 12 and the power feeding point of the monopole antenna 17 is set to 16 mm.

As represented in the graphs 1801 to 1803, the value of the $S_{32}$ parameter is relatively large over 1.5 GHz to 2 GHz. From this result, it may be understood that an electromagnetic coupling occurs between the multiband antenna 12 and the monopole antenna 17 over 1.5 GHz to 2 GHz.

Figure 19:
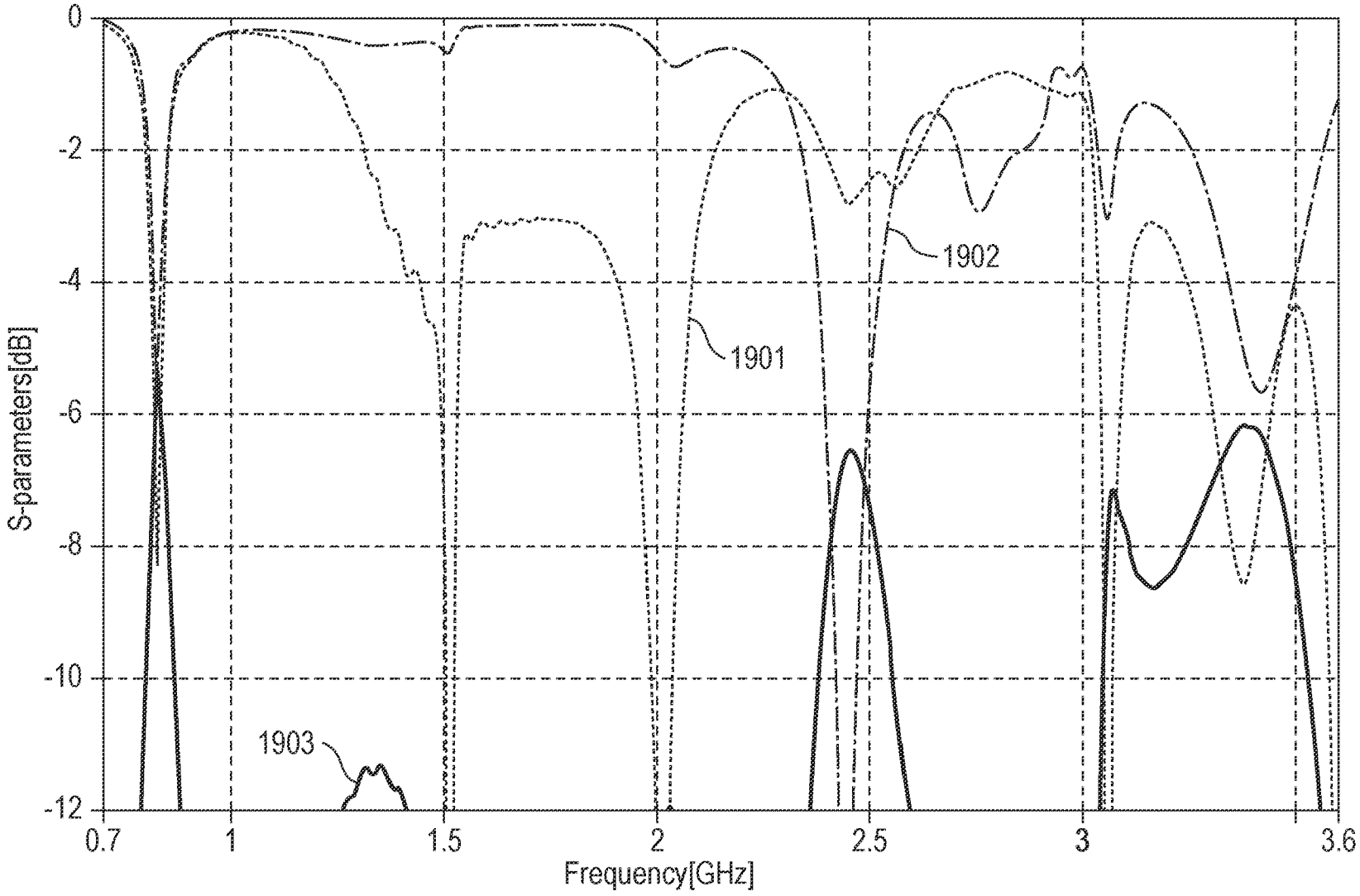
FIG. 19 is a graph illustrating a frequency characteristic of an S parameter of each antenna in a case where the monopole antenna is disposed in the vicinity of an end portion point of a first conductor which is the opposite side to the power feeding point of the multiband antenna as illustrated in FIG. 17B.

FIG. 19 is a graph illustrating a frequency characteristic of an S parameter of each antenna in a case where the monopole antenna 17 is disposed in the vicinity of the end portion point of the first conductor 3 which is opposite to the power feeding point of the multiband antenna as illustrated in FIG. 17B. In FIG. 19, the horizontal axis represents the frequency [GHz], and the vertical axis represents the $S_{11}$ parameter [dB]. A graph 1901 represents the frequency characteristic of the $S_{22}$ parameter which is obtained by the electromagnetic field simulation and indicates a reflection against the input of the multiband antenna 12. In addition, a graph 1902 represents the frequency characteristic of the $S_{33}$ parameter which is obtained by the electromagnetic field simulation and indicates a reflection against the input of the multiband antenna 17. In addition, a graph 1903 represents the frequency characteristic of the $S_{32}$ parameter which is obtained by the electromagnetic field simulation and indicates a degree of influx into the multiband antenna 12 from the monopole antenna 17.

In addition, in this electromagnetic field simulation, the dimensions of the respective parts of the multiband antenna 12 and the dimensions of the respective parts of the monopole antenna 17 are set to be the same as those used in the electromagnetic field simulation illustrated in FIG. 18. However, the distance between the power feeding point of the multiband antenna 12 and the power feeding point of the monopole antenna 17 is set to 60 mm.

As represented in the graphs 1901 to 1903, in this example, the value of the $S_{32}$ parameter at 1.5 GHz to 2 GHz is a substantially small value. From this result, it may be understood that the electromagnetic coupling between the multiband antenna 12 and the monopole antenna 17 is suppressed over 1.5 GHz to 2 GHz. This is because in the arrangement illustrated in FIG. 17B, the distance from the portion of the first conductor 3 in the vicinity of the monopole antenna 17 to the power feeding point 3*a* is not the integer multiple of ½ of the electrical length corresponding to 1.5 GHz to 2 GHz, and thus, the electric field in the vicinity of the power feeding point 3*a* is weakened at 1.5 GHz to 2 GHz.

Figure 20:
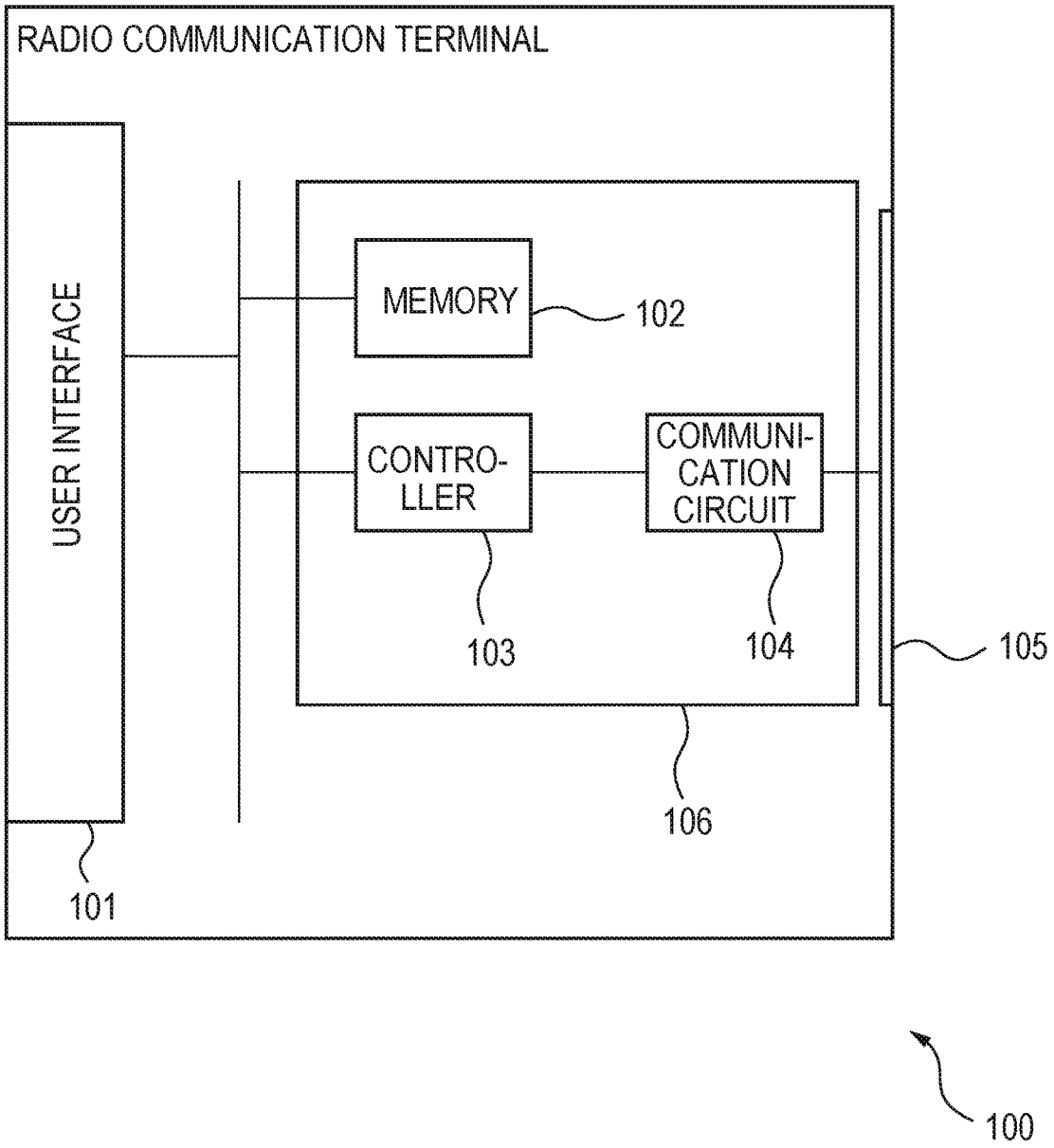
FIG. 20 is a schematic configuration diagram of a radio communication terminal including a multiband antenna according to any one of the embodiments and modifications thereof.
Figure 21:
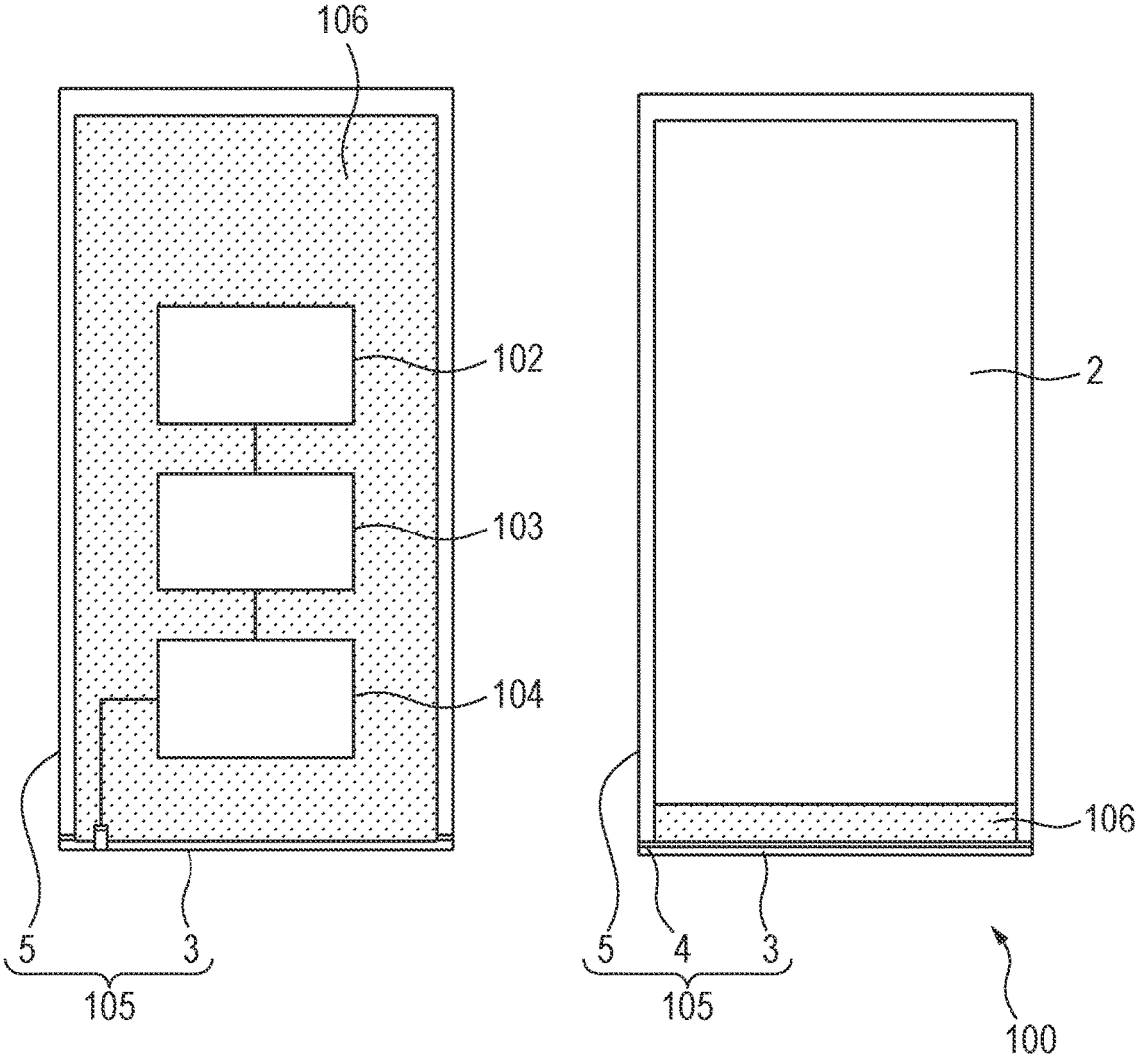
FIG. 21 is a schematic configuration view of the inside of the radio communication terminal illustrated in FIG. 20.

FIG. 20 is a schematic configuration diagram of the radio communication terminal provided with the multiband antenna according to any one of the embodiments or the modifications described above. FIG. 21 is a schematic configuration view of the inside of the radio communication terminal illustrated in FIG. 20. In this example, a radio communication terminal 100 is an example of a radio communication apparatus, and is, for example, a mobile phone. The radio communication terminal 100 includes a user interface 101, a memory 102, a controller 103, a communication circuit 104, a multiband antenna 105, and a substrate 106 formed of a dielectric. The memory 102, the controller 103, and the communication circuit 104 are formed as, for example, a single integrated circuit or multiple integrated circuits, and are mounted on one surface of the substrate 106. In addition, the radio communication terminal 100 may include a matching circuit (not illustrated) that matches the impedance of the communication circuit 104 with the impedance of the multiband antenna 105 between the communication circuit 104 and the multiband antenna 105. In addition, the radio communication terminal 100 may include a speaker (not illustrated) and a microphone (not illustrated).

The user interface 101 includes, for example, a touch panel display, generates a signal corresponding to an operation by a user, and sends the signal to the controller 103. Alternatively, the user interface 101 displays an image received from the controller 103.

The memory 102 includes, for example, a nonvolatile read-only semiconductor memory circuit and a volatile writable/readable semiconductor memory circuit. The memory 102 stores, for example, various programs that operate in the controller 103 and data used for the programs.

The controller 103 includes, for example, a single processor or multiple processors and a numerical operation circuit, and controls the entire radio communication terminal 100. In addition, the controller 103 executes a process corresponding to an operation by a user via the user interface 101, and various processes set to be executed in advance by the controller 103.

The communication circuit 104 includes a single processor or multiple processors, and executes a radio communication process according to a radio communication standard with which the radio communication terminal 100 complies. In addition, the communication circuit 104 generates a radio signal to be transmitted to another device, for example, a base station, and transmits the radio signal as a radio wave having any one of the first to third frequencies via the multiband antenna 105. Further, the communication circuit 104 demodulates a radio signal received from another device via the multiband antenna 105, extracts information included in the radio signal, and sends the information to the controller 103.

The multiband antenna 105 is a multiband antenna according to any one of the embodiments and modifications described above, and transmits the radio signal received from the communication circuit 104 as a radio wave having any one of the first to third frequencies. In addition, the multiband antenna 105 receives a radio wave having any one of the first to third frequencies from another device, converts the radio wave into a radio signal, and sends the radio signal to the communication circuit 104. In addition, the ground conductor 2 of the multiband antenna 105 is provided to cover, for example, the surface of the substrate 106 which is opposite to the surface of the substrate 106 with the memory 102, the controller 103, and the communication circuit 104 mounted thereon, and the lateral surface of the substrate 106. In addition, the first conductor 3 and the second conductor 4 are provided on, for example, one end side of the radio communication terminal 100 in the longitudinal direction thereof, and the third conductor 5 is provided to surround the ground conductor 2.

In addition, the first conductor 3 and the third conductor 5 of the multiband antenna 105 may be formed as a portion of the frame of the radio communication terminal 100. In addition, as illustrated in FIG. 13A or 13B, the radio communication terminal 100 may include two multiband antennas. Alternatively, as illustrated in FIG. 17A or 17B, the radio communication terminal 100 may include another antenna, for example, a monopole antenna together with the multiband antennas 105.

All examples and conditional language recited herein are intended for the pedagogical purposes to aid the reader in understanding the invention and the concepts contributed by the inventor to further the art, and are to be construed as being without limitation to such specifically recited examples and conditions, nor does the organization of such examples in the specification relate to a showing of the superiority and inferiority of the invention. Although the embodiments of the present disclosure have been described in detail, it should be understood that the various changes, substitutions, and alterations could be made hereto without departing from the spirit and scope of the invention.

What is claimed is:

1. A multiband antenna comprising:

a ground conductor coupled to a ground;

a first conductor disposed at a predetermined distance from the ground conductor, formed linearly, and configured to have a length to resonate at a first frequency and a second frequency different from the first frequency, the first conductor including a power feeding point at which an electric power is supplied;

a second conductor coupled to the first conductor at both ends of the second conductor, disposed closer to a side of the ground conductor than the first conductor, formed linearly, and configured to form a slit between the first conductor and the second conductor and resonate together with the first conductor at a third frequency different from the first frequency and the second frequency; and a third conductor provided at one or more ends of the first conductor and configured to extend from a first end of the one or more ends to the side of the ground conductor to be electromagnetically coupled to the ground conductor at the third frequency, wherein each of the ground conductor, the first conductor, the second conductor, and the third conductor has a conductivity.

2. The multiband antenna according to claim 1, wherein the third conductor is coupled to the first end and a second end of the one or more ends of the first conductor to surround the ground conductor.

3. The multiband antenna according to claim 2, wherein the third conductor is short-circuited with the ground conductor at a first position over the third conductor where a length from the power feeding point along the first conductor and the third conductor becomes an electrical length corresponding to the first frequency.

4. The multiband antenna according to claim 2, wherein the third conductor is short-circuited with the ground conductor at a second position over the third conductor where a length from the power feeding point along the first conductor and the third conductor becomes an electrical length corresponding to the second frequency.

5. The multiband antenna according to claim 3, further comprising:

a second frequency adjusting circuit disposed between the ground conductor and the third conductor at the first position and configured to adjust the first frequency.

6. The multiband antenna according to claim 4, further comprising:

a third frequency adjusting circuit disposed between the ground conductor and the third conductor at the second position and configured to adjust the second frequency.

7. The multiband antenna according to claim 1, further comprising:

a frequency adjusting circuit disposed between the second conductor and the first conductor at one or more ends of the both ends of the second conductor and configured to adjust the third frequency.

8. The multiband antenna according to claim 7, wherein the frequency adjusting circuit is configured to include at least one of a capacitor, an inductor, and a zero ohm resistor.

9. The multiband antenna according to claim 1, wherein a notch is formed at the first conductor.

10. The multiband antenna according to claim 1, wherein at least one of the first conductor and the third conductor forms a portion of a frame of a radio communication apparatus in which the multiband antenna is to be mounted.

11. A radio communication apparatus comprising:

a substrate;

a communication circuit provided over a first surface of the substrate and configured to radiate and receive a radio wave having any one of a first frequency, a second frequency, and a third frequency different from each other; and a first multiband antenna configured to include:

a ground conductor coupled to a ground and provided over a second surface of the substrate;

a first conductor disposed over a first end of the substrate at a predetermined distance from the ground conductor, formed linearly, and configured to have a length to resonate at the first frequency and the second frequency, the first conductor including a power feeding point at which an electric power supplied;

a second conductor coupled to the first conductor at both ends of the second conductor, disposed closer to a side of the ground conductor than the first conductor, formed linearly, and configured to form a slit between the first conductor and the second conductor and resonate together with the first conductor at the third frequency; and a third conductor provided at one or more ends of the first conductor and configured to extend from an end of the one or more ends to the side of the ground conductor to be electromagnetically coupled to the ground conductor at the third frequency, wherein each of the ground conductor, the first conductor, the second conductor, and the third conductor has a conductivity, and wherein the communication circuit radiates and receives the radio wave through the first multiband antenna.

12. The radio communication apparatus according to claim 11, further comprising:

a second multiband antenna configured to include:

a fourth conductor disposed over a second end of the substrate at a predetermined distance from the ground conductor, formed linearly, and configured to have a length to resonate at the first frequency and the second frequency, the forth conductor including a power feeding point at which an electric power is supplied; and a fifth conductor coupled to the fourth conductor at both ends of the fifth conductor, disposed closer to the side of the ground conductor than the fourth conductor, formed linearly, and configured to form a slit between the fourth conductor and the fifth conductor and resonate together with the fourth conductor at the third frequency, wherein each of the fourth conductor and the fifth conductor has the conductivity, and wherein the third conductor of the first multiband antenna is formed to be coupled from the first end of the first conductor to one end of the fourth conductor of the second multiband antenna.

13. The radio communication apparatus according to claim 12, wherein the second frequency is higher than the first frequency, and wherein the first multiband antenna and the second multiband antenna are arranged such that a distance between the power feeding point of the first multiband antenna and the power feeding point of the second multiband antenna along the first conductor, the third conductor, and the fourth conductor is different from an integer multiple of ½ of an electrical length corresponding to the second frequency.

14. The radio communication apparatus according to claim 13, wherein the third conductor is short-circuited with the ground conductor at a first position over the third conductor where a length from the power feeding point of the first multiband antenna along the first conductor and the third conductor becomes the electrical length corresponding to the second frequency, and the third conductor is short-circuited with the ground conductor at a second position over the third conductor where a length from the power feeding point of the second multiband antenna along the fourth conductor and the third conductor becomes the electrical length corresponding to the second frequency.

15. The radio communication apparatus according to claim 14, wherein the third conductor is short-circuited with the ground conductor at a third position between the first position and the second position.

16. The radio communication apparatus according to claim 11, further comprising:

an antenna configured to resonate at a fourth frequency different from the first frequency, the second frequency, and the third frequency.

* * * * *